US006695425B2

(12) United States Patent
Usui et al.

(10) Patent No.: US 6,695,425 B2
(45) Date of Patent: Feb. 24, 2004

(54) CONTROL DEVICE AND CONTROL METHOD FOR PRINT HEAD MECHANISM, AND PRINTER INCORPORATING THE SAME

(75) Inventors: Toshiki Usui, Nagano (JP); Noboru Asauchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/113,807

(22) Filed: Mar. 28, 2002

(65) Prior Publication Data

US 2003/0048317 A1 Mar. 13, 2003

(30) Foreign Application Priority Data

Mar. 28, 2001 (JP) ..... P2001-093045
Jun. 22, 2001 (JP) ..... P2001-189482
Mar. 22, 2002 (JP) ..... P2002-081367

(51) Int. Cl.[7] ..... B41J 29/38
(52) U.S. Cl. ..... 347/14

(58) Field of Search ..... 347/14, 17, 23, 347/19, 29.3, 32, 33

(56) References Cited

U.S. PATENT DOCUMENTS 6,386,672 B1 * 5/2002 Kimura et al. ..... 347/18

FOREIGN PATENT DOCUMENTS

JP 2000-238379 9/2000

* cited by examiner

*Primary Examiner*—Shih-wen Hsieh

(57) ABSTRACT

A print head mechanism performs printing predetermined image information on a fed recording medium, based on a given control signal. A detector detects an operating rate of the print head mechanism at a predetermined region on the recording medium every time when printing with respect to the predetermined region is finished. A comparator compares the operating rate with a given threshold operating rate. A controller halts the print head mechanism, when the operating rate exceeds the threshold operating rate, for a halting time period corresponding to an excess amount of the operating rate.

29 Claims, 23 Drawing Sheets

90

| TEMPERATURE | | PHOTO | MONOCHROME TEXT |
|---|---|---|---|
| LOW | | 170% | 140% |
| NORMAL | | 160% | 110% ~ 120% |
| HIGH | LOW | 140% | 100% |
| | | 130% | 90% |
| | | 120% | 80% |
| | HIGH | 110% | 70% |

FIG. 14

100

| TEMPERATURE (°C) | NUMBER OF NOZZLE |
|---|---|
| 0 ~ 60 | 288 |
| 61 ~ 70 | 240 |
| 71 ~ 80 | 192 |
| 81 ~ 90 | 144 |
| 91 ~ 100 | 96 |
| 101 ~ 105 | 0 |

FIG. 15

200

| TEMPERATURE (°C) | HALTED TIME PERIOD |
|---|---|
| 0 ~ 60 | 0.00 |
| 61 ~ 70 | 0.15 |
| 71 ~ 80 | 0.35 |
| 81 ~ 90 | 0.80 |
| 91 ~ 100 | 1.80 |
| 101 ~ 105 | 4.00 |

FIG. 16

300

| TEMPERATURE (°C) | | NOZZLE OPERATING RATE INTRINSIC TO PRINT DATA | | | | | | | | | |
|---|---|---|---|---|---|---|---|---|---|---|---|
| | | 1 ~ 20 | 21 ~ 40 | 41 ~ 60 | 61 ~ 80 | 81 ~ 100 | 101 ~ 120 | 121 ~ 140 | 141 ~ 160 | 161 ~ 180 | 181 ~ 200 |
| 0 ~ 60 | NUMBER OF NOZZLE | 288 | 288 | 288 | 288 | 288 | 288 | 288 | 288 | 288 | 288 |
| 61 ~ 70 | | 288 | 288 | 288 | 288 | 276 | 276 | 264 | 252 | 240 | 240 |
| 71 ~ 80 | | 288 | 288 | 288 | 272 | 272 | 256 | 240 | 224 | 208 | 192 |
| 81 ~ 90 | | 288 | 288 | 270 | 252 | 234 | 216 | 198 | 180 | 162 | 144 |
| 91 ~ 100 | | 288 | 264 | 264 | 240 | 216 | 192 | 168 | 144 | 120 | 96 |
| 101 ~ 105 | | 0 | 0 | 0 | 0 | 0 | 0 | 0 | 0 | 0 | 0 |

FIG. 17

400

| TEMPERATURE (°C) | | NOZZLE OPERATING RATE INTRINSIC TO PRINT DATA | | | | | | | | | |
|---|---|---|---|---|---|---|---|---|---|---|---|
| | | 1 ~ 20 | 21 ~ 40 | 41 ~ 60 | 61 ~ 80 | 81 ~ 100 | 101 ~ 120 | 121 ~ 140 | 141 ~ 160 | 161 ~ 180 | 181 ~ 200 |
| 0 ~ 60 | HALTED TIME PERIOD (SECOND) | 0.00 | 0.00 | 0.00 | 0.00 | 0.00 | 0.00 | 0.00 | 0.00 | 0.00 | 0.00 |
| 61 ~ 70 | | 0.00 | 0.00 | 0.00 | 0.00 | 0.03 | 0.05 | 0.08 | 0.10 | 0.13 | 0.15 |
| 71 ~ 80 | | 0.00 | 0.00 | 0.00 | 0.05 | 0.10 | 0.15 | 0.20 | 0.25 | 0.30 | 0.35 |
| 81 ~ 90 | | 0.00 | 0.00 | 0.10 | 0.20 | 0.30 | 0.40 | 0.50 | 0.60 | 0.70 | 0.80 |
| 91 ~ 100 | | 0.00 | 0.20 | 0.40 | 0.60 | 0.80 | 1.00 | 1.20 | 1.40 | 1.60 | 1.80 |
| 101 ~ 105 | | 0.40 | 0.80 | 1.20 | 1.80 | 2.00 | 2.40 | 2.80 | 3.20 | 3.60 | 4.00 |

FIG. 28

500

| AMBIENT TEMPERATURE (°C) | 0 | 5 | 10 | 15 | 20 | 25 | 30 | 35 | 40 | 45 | 50 |
|---|---|---|---|---|---|---|---|---|---|---|---|
| THRESHOLD VALUE (%) | 250 | 240 | 220 | 200 | 180 | 160 | 140 | 120 | 100 | 90 | 80 |

CONTROL DEVICE AND CONTROL METHOD FOR PRINT HEAD MECHANISM, AND PRINTER INCORPORATING THE SAME

BACKGROUND OF THE INVENTION

The present invention relates to a printing apparatus such as a printer, and more particularly, to a technique for preventing heat generation from a drive section for a print head.

Since an ink jet printer can produce a high-resolution, full-color print, the ink jet printer is now in widespread use. Because of ease of control operation, such as finely-controlled formation of ink dots, a print head drive system for ejecting ink droplets by utilization of flexural vibration of a piezoelectric element has become pervasive as a print head drive system of such an ink jet printer. When a print head is driven by utilization of such flexural vibration of a piezoelectric element, the power consumed in a power transistor for activating a piezoelectric element is approximately 10 to 30 W. If a printing operation involving a high nozzle operating rate (i.e., a high duty factor) is performed continuously, the temperature of the power transistor increases. In the event that the temperature of the power transistor exceeds a temperature of 150° C., the power transistor is subjected to thermal breakdown. In order to prevent occurrence of such a problem, a cooling fan or a heat sink for heat radiation purpose is provided in the vicinity of a drive section of the print head. Heat of the power transistor is cooled by activation of the cooling fan or dissipated through a heat sink, thereby preventing a rise in the temperature of the power transistor.

However, when, for example, a cooling fan is used, a drive circuit or control circuit of the fan must be incorporated in a printer. As a result, the printer per se becomes bulky, or an increase in the number of parts adds to cost.

However, in the case of an ink jet printer in which one head is constituted of a total of six nozzle groups; that is, a black (K) nozzle group, a yellow (Y) nozzle group, a cyan (C) nozzle group, a magenta (M) nozzle group, a light cyan (LC) nozzle group, and a light magenta (LM) nozzle group, switching semiconductor elements for driving ink nozzles are mounted for the respective nozzle groups. For instance, in the case of a printer equipped with a print head constituted of 48 nozzles (n=48) for each color, 48 switching circuits are included in a switching semiconductor element to be constituted into one chip. At the time of assembly of an ink jet printer, chips are attached to respective nozzle groups. When an attempt is made to drive the respective nozzle groups, a drive voltage is applied to a total of 288 piezoelectric vibrators. A case where all nozzles for one color have ejected ink is taken as a nozzle operating rate of 100%. In a case where a total of 288 nozzles for six ink colors are caused to eject ink, a nozzle operating rate of 600% is achieved.

However, when a normal printing operation is performed through use of a color ink jet printer, a case where ink is ejected simultaneously from all nozzles of all color heads; that is, a case where a nozzle operating rate of 600% is achieved, would be extremely unusual. For example, even at the time of printing of bit map data of true color commonly used as a print sample, the nozzle operating rate does not exceed 130%.

For this reason, it is considered that a transistor capable of withstanding a nozzle operating rate of about 200%, allowing for a safety factor of about 70%, is selected and adopted in a process for assembling a printer and that a heat sink of sufficient size for continuously operating at a nozzle operating rate of 200% is attached to the transistor for radiation purpose.

However, depending on the design of a printer driver of a host computer or the configuration of an operating system, there may arise a case where a nozzle operating rate exceeds 200%. However, if a transistor capable of withstanding excessive load such as a nozzle operating rate of 600% is selected, costs will increase. Moreover, use of a large heat sink results in upsizing of a component to be mounted.

For these reasons, the following technique is proposed in, e.g., Japanese Patent Publication No. 2000-238379A. Specifically, an initial temperature of a print head is determined on the basis of a detection signal output from a temperature sensor provided in a printer. Temperature rises in individual sections of the printer from the initial temperature are predicted on a per-predetermined-print-area basis. If the predicted temperature may exceed a predetermined threshold value, a print speed is regulated. Even when a printing operation is continuously performed at high duty factor, the thus-proposed technique enables prevention of thermal breakdown of a power transistor, as well as limiting a drop in throughput to a minimum level.

However, if a difference exists between the thus-predicted temperature and an actual temperature, there may arise a case where a print speed is limited more than necessary when a printing operation is performed at high duty factor, or where overheating of the power transistor cannot be prevented.

SUMMARY OF THE INVENTION

It is therefore an object of the present invention to provide a printing apparatus which effectively prevents heating of a drive section of a print head even at the time of printing operation being performed at high duty factor without involvement of a cost hike or upsizing of components to be mounted and suppression of a drop in print processing speed to a minimum.

In order to solve the problem, according to the present invention, there is provided a printing apparatus, comprising:

- a print head mechanism, which performs printing predetermined image information on a fed recording medium, based on a given control signal;
- a detector, which detects an operating rate of the print head mechanism at a predetermined region on the recording medium every time when printing with respect to the predetermined region is finished;
- a comparator, which compares the operating rate with a given threshold operating rate; and
- controller, which halts the print head mechanism, when the operating rate exceeds the threshold operating rate, for a halting time period corresponding to an excess amount of the operating rate.

In this configuration, there can be provided a highly-reliable printing apparatus which can suppress a drop in print processing speed to a minimum value even at the time of a printing operation to be performed at high duty factor and thereby inhibit heating of a driving section of the print head mechanism.

The printing apparatus may be a serial printer, the recording medium may be print paper, and the predetermined region may be either one raster or one page defined on the recording medium.

The operating rate is an average operating rate which is determined by either an ink dot count or a consumed ink amount while the print head mechanism performs printing the image information on the recording medium.

The threshold operating rate is varied in accordance with change in an external ambient temperature of the printing apparatus. The change in the external ambient temperature is detected based on a temperature detection signal sent from a temperature detector provided externally.

The operating rate may be varied in accordance with change in an internal ambient temperature of the printing apparatus. The change in the internal ambient temperature is detected based on a temperature detection signal sent from a temperature detector provided with the print head mechanism.

The operating rate may be varied in accordance with change in a temperature of a semiconductor switching element in a drive circuit for driving the print head mechanism. The change in the internal ambient temperature is detected based on a temperature detection signal sent from a temperature detector provided with the semiconductor switching element.

When the halting time period is longer than either a raster changing time period of the print head mechanism or a standby time period for which printing on a new recording medium is started, the print head mechanism may be halted for a time period corresponding to a difference between the halting time period and the raster changing time period or the standby time period.

According to the present invention, there is also provided an apparatus for controlling a print head mechanism, which performs printing predetermined image information on a fed recording medium, based on a given control signal, comprising:

a detector, which detects an operating rate of the print head mechanism at a predetermined region on the recording medium every time when printing with respect to the predetermined region is finished;

a comparator, which compares the operating rate with a given threshold operating rate; and controller, which halts the print head mechanism, when the operating rate exceeds the threshold operating rate, for a halting time period corresponding to an excess amount of the operating rate.

According to the present invention, there is also provided a method for controlling a print head mechanism, which performs printing predetermined image information on a fed recording medium, based on a given control signal, comprising the steps of:

detecting an operating rate of the print head mechanism at a predetermined region on the recording medium every time when printing with respect to the predetermined region is finished;

comparing the operating rate with a given threshold operating rate; and halting the print head mechanism, when the operating rate exceeds the threshold operating rate, for a halting time period corresponding to an excess amount of the operating rate.

According to the present invention, there is also provided a computer program for controlling a print head mechanism, which performs printing predetermined image information on a fed recording medium, based on a given control signal, comprising the steps of:

detecting an operating rate of the print head mechanism at a predetermined region on the recording medium every time when printing with respect to the predetermined region is finished;

comparing the operating rate with a given threshold operating rate; and halting the print head mechanism, when the operating rate exceeds the threshold operating rate, for a halting time period corresponding to an excess amount of the operating rate.

According to the present invention, there is also provided a printing apparatus, comprising:

a temperature monitor, which monitors a temperature of a transistor which generates a voltage waveform for driving a print head to transmit temperature information; and a drive controller, which drives the print head while reducing an operation rate of nozzles in the print head, based on the temperature information transmitted from the temperature monitor.

The drive controller may include a storage which stores temperatures of the transistor to be monitored in association with numbers of operable nozzle. The drive controller may read a number of operable nozzle from the storage based on the temperature information so that only the read number of nozzles are operated to reduce the operating rate.

The numbers of operable nozzle may be stored in association with each color nozzle array.

The numbers of operable nozzle for the respective nozzle arrays may be identical with each other, or may be different from each other.

The number of operable nozzle may be determined with respect to total number of nozzles of all nozzle arrays. The drive controller may set the number of operable nozzle for each color nozzle array in a real-time manner.

The drive controller may include a past operation evaluator, which determines whether the reduction of nozzle operation rate is performed upon a current printing, based on a past nozzle operation of the print head.

The past operation evaluator may perform the determination based on a time period elapsed from a previous driving of the print head.

The past operation evaluator may perform the determination based on an accumulated count of nozzle operation at a previous driving of the print head.

The drive controller may perform the reduction of nozzle operation rate, only when a print head is not in a scanning operation.

According to the present invention, there is also provided a printing apparatus, comprising:

a temperature monitor, which monitors a temperature of a transistor which generates a voltage waveform for driving a print head to transmit temperature information; and a drive controller, which drives the print head while reducing an operation rate of nozzles in the print head, based on the temperature information transmitted from the temperature monitor, wherein:

the drive controller includes a storage which stores temperatures of the transistor to be monitored in association with time periods for which nozzle operation is halted; and the drive controller reads a time period from the storage based on the temperature information so that nozzle operation is halted for the read time period.

According to the present invention, there is also provided a printing apparatus, comprising:

a temperature monitor, which monitors a temperature of a transistor which generates a voltage waveform for driving a print head to transmit temperature information;

a drive controllers which drives the print head while reducing an operation rate of nozzles in the print head, based on the temperature information transmitted from the temperature monitor; and a storage which stores temperatures of the transistor to be monitored in association with time periods for which nozzle operation is halted, wherein the drive controller reads a time period from the storage based on the temperature information so that nozzle operation is halted for the read time period.

In the above configurations, the temperature of a transistor is monitored, and temperature information is handed to the drive controller. The print head can be actuated by reducing the operating rate of nozzles of the print head with utilization of the temperature information. Further, there can be achieved fine head drive control in which, even when operation of the head is halted by utilization of the temperature information, printing operation is not halted as a fatal error, and in which a most appropriately-conceivable halted time period can be selected from alternatives. As a result, mounted components can be protected from a risk of heating, thus increasing the degree of freedom in selecting and designing components.

BRIEF DESCRIPTION OF THE DRAWINGS

FIG. 14 shows a table stored in a control manager shown in FIG. 7 (corresponding to procedures depicted in FIGS. 8 and 9);

FIG. 15 shows a table stored in the control manager shown in FIG. 7 (corresponding to procedures depicted in FIGS. 11 and 12);

FIG. 16 shows a table stored in the control manager shown in FIG. 7 (corresponding to procedures depicted in FIG. 10);

FIG. 17 shows a table stored in the control manager shown in FIG. 7 (corresponding to procedures depicted in FIG. 13);

FIG. 28 shows a table of threshold operating rate data based on ambient temperature.

DETAILED DESCRIPTION OF THE PREFERRED EMBODIMENTS

Embodiments of the invention will be described in more detail by reference to the drawings.

Figure 1:
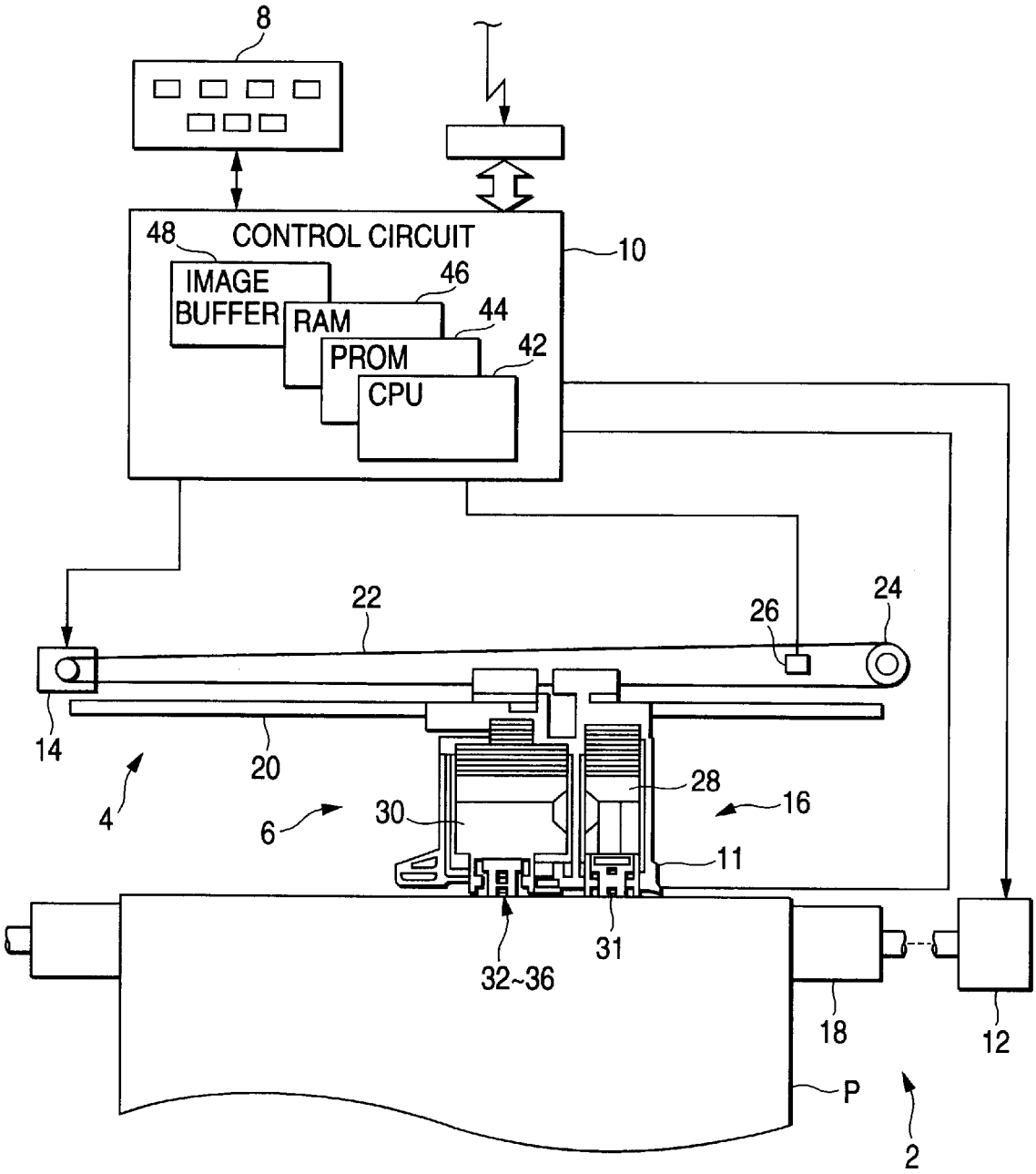
FIG. 1 is a schematic block diagram of a mechanical segment of a serial printer serving as an example of a printing apparatus according to the invention.

As shown in FIG. 1, a printer main unit is equipped with a print paper transporting mechanism 2, a carriage traveling mechanism 4, a print head mechanism 6, a control panel 8, and a control circuit 10. The print paper transporting mechanism 2 is for transporting print paper P while a paper feed motor 12 is taken as a drive source. The carriage traveling mechanism 4 is for moving a carriage 16 back and forth in an axial direction of a platen 18 while a carriage motor 14 is taken as a drive source. The carriage traveling mechanism 4 has a slide shaft 20 which is provided in parallel with the shaft of a platen 18 and holds the carriage 16 in a slidable manner; a pulley 24 with an endless drive belt 22 being stretched between the carriage motor 14 and the pulley 24; and a position detection sensor 26 for detecting the home position of the carriage 16. The carriage 16 is constructed so that a black ink (K) cartridge 28 and a color ink cartridge 30 storing five colors of ink; that is, yellow (Y), cyan (C), magenta (M), light cyan (LC), and light magenta (LM), can be mounted on the carriage 16.

As illustrated, the print head 11 is situated at a position below the carriage 16, and a total of six actuators 31 through 36 are formed in the print head 11. The print head mechanism 6 drives the print head 11 to eject ink, thus forming dots. In accordance with an instruction output from the control panel 8, the control circuit 10 controls the paper feed motor 12, the carriage motor 14, and the print head 11. The control circuit 10 incorporates a CPU 42, a PROM 44, a RAM 46, and an image (obtaining) buffer 48. The print paper transporting mechanism 2 corresponds to the paper feeding mechanism 9 shown in FIG. 2, and the control circuit 10 corresponds to the processor 19 shown in FIG. 2.

Figure 2:
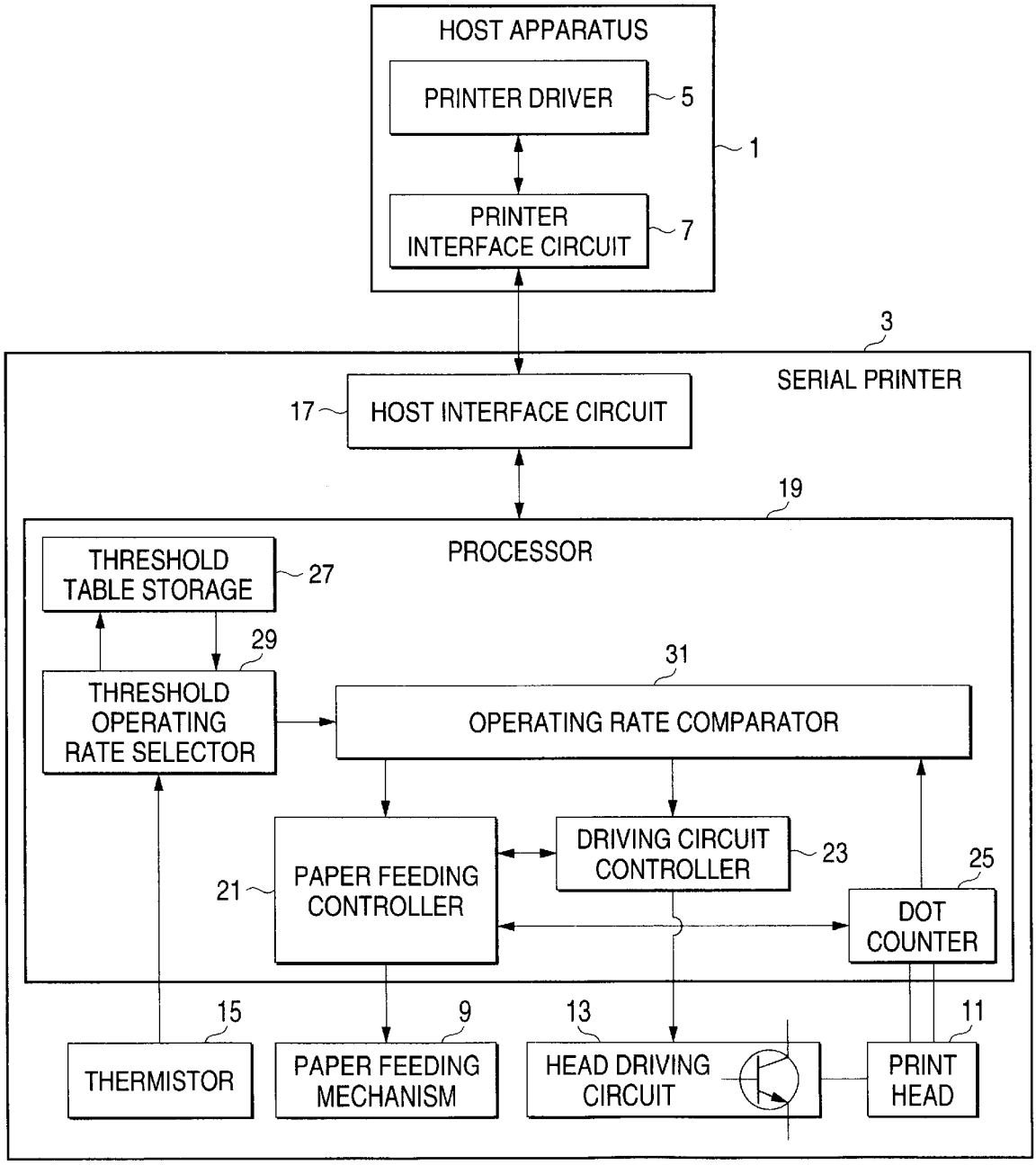
FIG. 2 is a block diagram showing the schematic, entire configuration of a printer system including the serial printer serving as an example of the printing apparatus.

FIG. 2 is a block diagram showing the schematic configuration of a printing system including an ink jet printer serving as an example of the printing apparatus.

As shown in FIG. 2, the printing system comprises a host apparatus 1, and a printer main unit 3 which performs a predetermined printing operation under control of the host apparatus 1. The host apparatus 1 is equipped with a printer driver 5 incorporated as a program module for controlling a printer, and a printer interface circuit (printer I/F circuit) 7. The printer main unit 3 is equipped with a paper feeding mechanism 9, a print head 11, a head driving circuit 13, a thermistor 15, a host interface (host I/F circuit) 17, and a processor 19 constituted of an internal CPU of the printer main unit 13. The processor 19 has various functions represented by functional blocks; that is, a paper feeding controller 21; a drive circuit controller 23; a dot counter 25; a (nozzle) threshold table storage 27; a (nozzle) threshold operating rate selector 29; and a (nozzle) operating rate comparator 31.

In the host apparatus 1, the printer driver 5 performs, for example, generation of print data, and determination of a sequence in which the thus-produced print data are to be transferred to a printer. The printer l/F circuit 7 serves as an interface by way of which various information items for printing operation are exchanged between the printer driver 5 and the processor 19 by way of the host I/F circuit 17.

As is evident from the foregoing descriptions, the host I/F circuit 17 of the printer main unit 3 and the printer I/F circuit 7 serve as interfaces by way of which various information items for printing operation are exchanged between the processor 19 and the printer driver 5.

The paper feeding mechanism 9 has a pair of paper feeding rollers (not shown) disposed at a position close to a paper feeding tray, and a pair of paper ejection rollers (not shown) disposed at a position close to a paper ejection tray. Under the control of the paper feeding controller 21, the paper feeding mechanism 9 transports print paper (not shown) acquired from the paper feeding tray to the front side of the print head 10 along a platen (not shown) by rotation of the pair of paper feeding rollers. Further, the print paper that has been subjected to printing performed by the print head 11 is ejected to the paper ejection tray by rotation of the pair of paper ejection rollers. In order to detect the presence/absence of print paper, there may be adopted a construction wherein a paper detection sensor (not shown) of contact type is disposed at a position ahead of the print head 11 in a path along which print paper is to be transported (not shown), and a detection signal output from the paper detection sensor is output to the paper feeding controller 21.

In accordance with the control signal output from the processor 19 to the head driving circuit 13, the print head 11 prints image information on print paper. In the present embodiment, the print head 11 employs a print head capable of performing printing operation through use of six colors of ink; that is, cyan (C), magenta (M), yellow (Y), black (K), light cyan (LC), and light magenta (LM), so as to be compatible with a photo print of full-color stationary image information. The print head has, for example, 48 ink ejection nozzles for each color. Colors of ink supplied individually from the respective color ink cartridges are ejected from the respective ink ejection nozzles. Each of the ink ejection nozzles is provided with a piezoelectric element (not shown) whose volume is changed by application of a voltage, to thereby generate drive force for ejecting ink. A drive voltage having a predetermined waveform is applied to the piezoelectric element from a drive source (not shown) of the printer main unit 3, by way of the head driving circuit 13, which is under control of the drive circuit controller 23.

The head driving circuit 13 has an NPN power transistor and a PNP power transistor, which serve as semiconductor switching elements and are to be biased by the drive source. Those power transistors perform switching operations in accordance with a control signal output from the drive circuit controller 23 and actuate the respective piezoelectric elements by applying the drive voltage of predetermined waveform to the respective piezoelectric elements.

In the embodiment, the thermistor 15 is attached to a radiator (heat sink) of each power transistor for detecting the internal ambient temperature of the printer main unit 3 and outputs a detection signal corresponding to a change in the temperature of the heat sink to the threshold operating rate selector 29. In addition to the thermistor 15, the printer main unit 3 also has a thermistor provided in the print head 11 for stabilizing ejecting ink from the ink ejection nozzles.

In the processor 19, the paper feeding controller 21 controls driving of the pair of paper feeding rollers (not shown), on the basis of the detection signal output from the contact-type paper detection sensor (not shown) and a notification output from an operating rate comparator 31 which notifies a result of comparison between a nozzle threshold operating rate and an actual average operating rate (average operating rate) of the print head 11. As a result, a paper feeding rate employed at the time of printing of single print paper (a cut sheet), a paper feeding rate employed at the time of continuous printing of a plurality of sheets of print paper, a paper feeding rate employed at the time of continuous printing of a so-called continuous roll of paper, and a paper-feed standby time period arising between paper sheets at the time of continuous printing operation of a plurality of sheets of print paper are controlled to appropriate values. The information relating to a paper feeding rate, a standby time period, and detection of print paper by the paper detection sensor is reported from the paper feeding controller 21 not only to the drive circuit controller 23, but also to the dot counter 25, as required, such that the print head 11 prints the image information output from the host apparatus 1, at high quality onto print paper.

Every time printing operation in a predetermined area on print paper is finished, the dot counter 25 detects an average operating rate of the print head 11 in that area. More specifically, in accordance with the information reported by the paper feeding controller 21, the number of ink droplets ejected onto print paper from each of the ink ejection nozzles contained in the print head 1 is counted on a per-raster (i.e., line) basis for the case of printing of a single page (cut sheet), on a per-raster or per-page basis for the case of printing of a plurality of pages, and a per-raster basis or a per-predetermined-number-of-rasters basis for the case of printing of so-called roll paper. An average operating rate of the print head 11 determined from the count results is output to the operating rate comparator 31.

In accordance with the notification output from the paper feeding controller 21, the drive circuit controller 23 ascertains the current position of a print area (i.e., each raster) on print paper and a paper feeding rate. In accordance with the notification output from the operating rate comparator 31, the power transistors are caused to perform switching operation. The piezoelectric elements are controlled by applying the drive voltage to the respective piezoelectric elements. As a result, the image information output from the host apparatus 1 is printed on print paper.

The threshold table storage 27 stores a table in which are set different threshold operating rates corresponding to a case where the internal ambient temperature assumes a standard value (i.e., a normal temperature) and a temperature close to the normal temperature, those corresponding to a case where the internal ambient temperature falls within a temperature range higher than the normal temperature, and those corresponding to a case where the internal ambient temperature falls within a temperature range lower than the normal temperature.

Figures 3, 4:
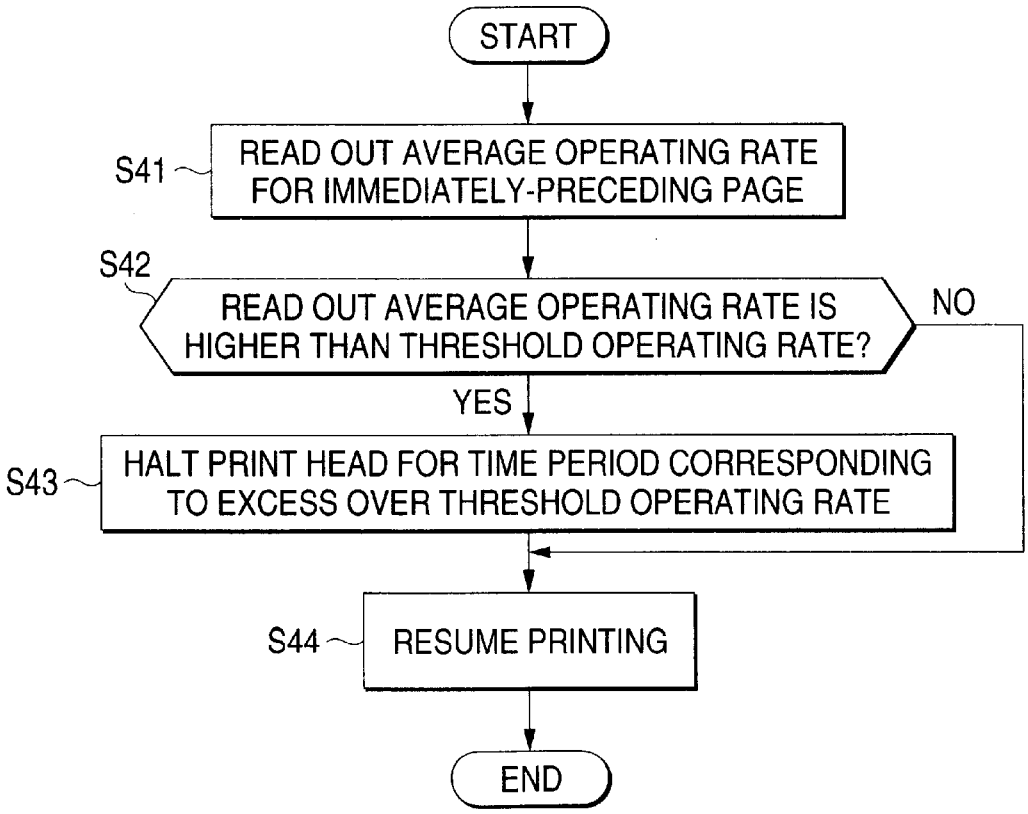
FIG. 3 shows a table held in a threshold table storage shown in FIG. 2.
FIG. 4 is a flowchart showing processing operations of functional blocks included in a processor shown in FIG. 1 according to an embodiment 1-1 of the invention.

FIG. 3 shows this table 90. The temperature range higher than the normal temperature is divided into a plurality of sub-ranges from a relatively high temperature range including a critical temperature at which thermal breakdown of the power transistor arises, to a relatively low range close to the normal temperature. A design threshold operating rate determined for each model of the printer main unit 3 is set for the normal temperature. An operating threshold value which has been changed to a value lower than the design value is set for the high temperature range. A threshold operating rate which has been changed to a value higher than the design value is set for the low temperature range. The higher the temperature, the lower the threshold operating rates set for the respective sub-regions within the high temperature range.

The internal ambient temperature per se usually designates a value which is about 20° C. lower than the temperature of the power transistor at the time of activation. Hence, for example, the normal temperature is set to 80° C., which is lower than 100° C. by 20° C. The upper limit of the temperature range belonging to the high temperature range is set to 130° C., which is lower by 20° C. than 150° C. where the power transistor will be thermally broken down.

In a case where the printer main unit 3 is, for example, a photo printer, an average operating rate of the printer main unit is 160%. The value of 160% is set in the table as an operating threshold value of the printer main unit 3 so as to correspond to the normal temperature (80° C.). In a case where the printer main unit 3 is, for example, a printer for producing a monochrome text, an average operating rate of the printer main unit is 110 to 120%. The value ranging from 110 to 120% is set in the table 90 as an operating threshold value of the printer main unit 3 so as to correspond to the normal temperature (80° C.).

Provided that the printer head 11 has 48 ink ejection nozzles for each color as mentioned above, a threshold operating rate of 100% means a state in which all 48 nozzles are used for printing information in one color of ink at all times. When the printer main unit 3 serving as a photo printer is performing a photo printing operation, which is the original application of the printer main unit 3, an average operating rate assumes a value of 160%. Hence, the internal ambient temperature of the printer will never reach a temperature of 130° C. (i.e., the temperature of the power transistor will never reach a temperature of 150° C.). As will be described later, the printer main unit 3 will not halt during the course of a printing operation. When the printer main unit 3 is performing a printing operation, which is the original application of the printer, an average operating rate assumes a value of 110 to 120%. Hence, the internal ambient temperature will never reach 130° C. (i.e., the temperature of the power transistor will never reach a temperature of 150° C.). Consequently, the printer main unit 3 will not halt during the course of printing operation.

A threshold operating rate selector 29 ascertains the internal ambient temperature on the basis of the temperature detection signal output from the thermistor 15 and determines whether the internal ambient temperature is equal to the normal temperature (80° C.) or a temperature close thereto (e.g., a value around 100° C.). If the check result shows that the detected temperature (i.e., the internal ambient temperature) is close to neither the normal temperature nor a value close thereto, an operating threshold value corresponding to the temperature detection signal is selected as a new threshold operating rate from the threshold table storage 27. The new threshold operating rate is output to the operating rate comparator 31.

For instance, in the case of a photo printer, if the detected internal ambient temperature is lower than the normal temperature for reasons of a low external ambient temperature (i.e., a temperature outside the printer main unit 3 or the temperature of a room in which the printer main unit 3 is disposed), as in the case of use during early morning in midwinter, the threshold operating rate selector 29 selects a value (e.g., 170%) higher than the operating threshold value (160%) as a new threshold operating rate from the threshold table storage 27, and the thus-selected value is output to the operating rate comparator 31. In contrast, if the internal ambient temperature is higher than the normal temperature for reasons of a high external ambient temperature, as in the case of use during the afternoon in midsummer, the threshold operating rate selector 29 selects a value (e.g., 140%) lower than the threshold operating rate (160%) from the threshold table storage 27 as a new threshold operating rate, and the thus-selected value is output to the operating rate comparator 31.

When the external ambient temperature in the case of use during early morning in midwinter is compared with that in the case of use during the afternoon in midsummer, the former temperature differs from the normal temperature by a greater amount than does the latter temperature. If an threshold operating rate is determined in terms of only a temperature, a greater threshold operating rate can be set at a lower internal ambient temperature than at a higher internal ambient temperature. However, the viscosity of ink is greater at the former low temperature than at the latter high temperature. Hence, in order to stabilize ink ejection and to prevent a quality deterioration in a print image, the energy for driving the piezoelectric elements (i.e., an electric current) must be increased by setting the drive voltage to be applied to the piezoelectric elements in the former case higher than that applied in the latter case. Eventually, an increase in electric current results in an increase in internal ambient temperature. Even if the threshold operating rate employed in the former case is set so as to become equal to that employed in the latter case, the internal ambient temperature obtained in the former case will become higher than that obtained in the latter case. In the worst case, there may arise a case where damage is inflicted on a PN junction of the power transistor. For this reason, when the threshold operating rate selector 29 selects an threshold operating rate, not only must an internal ambient temperature be ascertained, but also a drive voltage to be applied to the respective piezoelectric elements must be taken into consideration. In this case, as a matter of course, the threshold table storage 27 must store not only the internal ambient temperature but also a table in which the drive voltages are associated with the respective threshold operating rates.

Every time printing operation for one raster, one page, or a predetermined number of rasters is completed, the operating rate comparator 31 compares an average operating rate of the print head 11 determined by the dot counter 25 with the threshold operating rate selected from the operating rate threshold table storage 27 by the threshold operating rate selector 29. If the comparison result shows that the average operating rate has exceeded the threshold operating rate, the amount by which the operating rate is exceeded is converted into a time. The thus computed time is taken as a halted time period for the print head 11. For example, the printer main unit 3 is a printer for printing a monochrome text and a typical document (normal text data) is being printed, the average operating rate of the print head 11 will not exceed the threshold operating rate of 110 to 120% (i.e., an average operating rate). However, in some cases, there may arise a case where an image, for which the average operating rate of the print head 11 will exceed the threshold operating rate, is present as image data. In such a case, the average operating rate exceeds the threshold operating rate.

Provided that 0.5 seconds are required for printing text for one raster and that average operating rate has exceeded the threshold operating rate by 10%, the operating rate comparator 31 sets 0.05 seconds (corresponding to 10% of 0.5 seconds) as a halted time period of the print head 11.

The operating rate comparator 31 compares the halted time period of the print head 11 with a time period required for line-changing or a standby time period for initiation of printing on new print paper. If the halted time period is longer than the line-changing time period or the standby time period, a notification is sent to the drive circuit controller 23 for halting operation of the print head 11 for only a time period corresponding to a difference between the halted time period and the line-changing time period or a difference between the halted time period and the standby time period. If the halted time period is shorter than the line-changing time period or the standby time period, the halted time period is included in the line-changing time period or the standby time period. Hence, the operating rate comparator 31 does not send any notification.

FIG. 4 is a flowchart showing processing operations of individual functional blocks contained in the processor 19 shown in FIG. 2 according to an embodiment 1-1 of the invention. The flowchart shown in FIG. 4 is used when the dot counter 25 counts the number of ink droplets ejected onto print paper from the respective ink ejection nozzles of the print head 11 on a per-page basis and outputs an average operating rate determined from the count result to the operating rate comparator 31.

As shown in FIG. 4, the operating rate comparator 31 reads an average operating rate relating to an immediately-preceding page determined by the dot counter 25 (step S41). The average operating rate is compared with the threshold operating rate that is read from the threshold table storage 27 by way of the threshold operating rate selector 29 (step S42). If the comparison result shows that the average operating rate is greater than the threshold operating rate, a time period, into which a difference between the average operating rate and the threshold operating rate has been converted, is taken as a halted time period of the print head 11. If the halted time period is longer than a standby time period required for feeding paper, operation of the print head 11 is resumed at a point in time when the halted time period has elapsed (steps S43, S44). In contrast, if the halted time period is shorter than the standby time period required for feeding paper or it a time required for replenishing a paper feeding tray with paper due to a paper empty state (i.e., a replenishment time period) or a time required for awaiting image data from the host apparatus 1 (i.e., a standby time period), either time being longer than the halted time period, overlaps the halted time period, operation of the print head 11 is resumed after lapse of the halted time period and subsequent lapse of the replenishment or standby time period (steps S43, S44). If in step S42 the threshold operating rate is determined to be greater than the average operating rate, operation of the print head 11 is resumed immediately (step S44).

Figure 5:
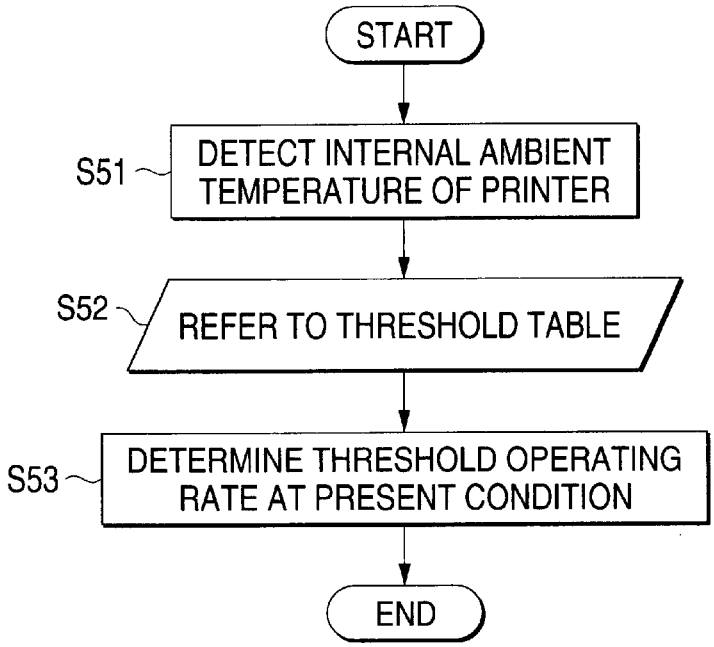
FIG. 5 is a flowchart showing processing operation when the threshold operating rate selector shown in FIG. 2 selects an threshold operating rate.

FIG. 5 is a flowchart showing processing operation required when the threshold operating rate selector 29 shown in FIG. 2 selects an threshold operating rate. As shown in FIG. 5, a temperature detection signal output from the thermistor 15 is read, whereby the internal ambient temperature is ascertained (step S51). Subsequently, a check is made as to whether the internal ambient temperature is equal to the normal temperature or to a temperature close to the normal temperature. If the result of check shows that the detected temperature is the normal temperature or a value close thereto, there is selected an threshold operating rate corresponding to the normal temperature (e.g., 160% is selected in a case where the printer main unit 3 is a photo printer) (step S53), by reference to the threshold table storage 27 (step S52). The thus-selected threshold operating rate is output to the threshold operating rate comparator 31. In contrast, if the result of check shows that the detected temperature is neither the normal temperature nor a temperature close thereto, a new threshold operating rate corresponding to the temperature detection signal is selected from the threshold table storage 27 (step S53). The new threshold operating rate is output to the operating rate comparator 31.

In relation to the table 90, if a design threshold operating rate and its modification are not set in accordance with a change in the internal ambient temperature which can be conceived at the time of operation of the print head 11 i.e., temperature changes of the heat sinks attached to the respective power transistors) but are set according to the waveform of a drive voltage applied to each of the piezoelectric elements, the threshold operating rate selector 29 computes the waveform of the drive voltage corresponding to the temperature detection signal. On the basis of the result of computation, a new threshold operating rate is selected from the threshold table storage 27 by reference thereto (step S52, S53). Here, the waveform of a drive voltage applied to each of the piezoelectric element varies according to the internal ambient temperature, for the following reasons. The electric characteristics of the respective piezoelectric elements vary in accordance with the temperatures of the elements, and also the viscosity of ink ejected from each ink ejection nozzle varies with temperature. For these reasons, the drive voltages are optimized by the temperatures of the piezoelectric elements.

Figure 6:
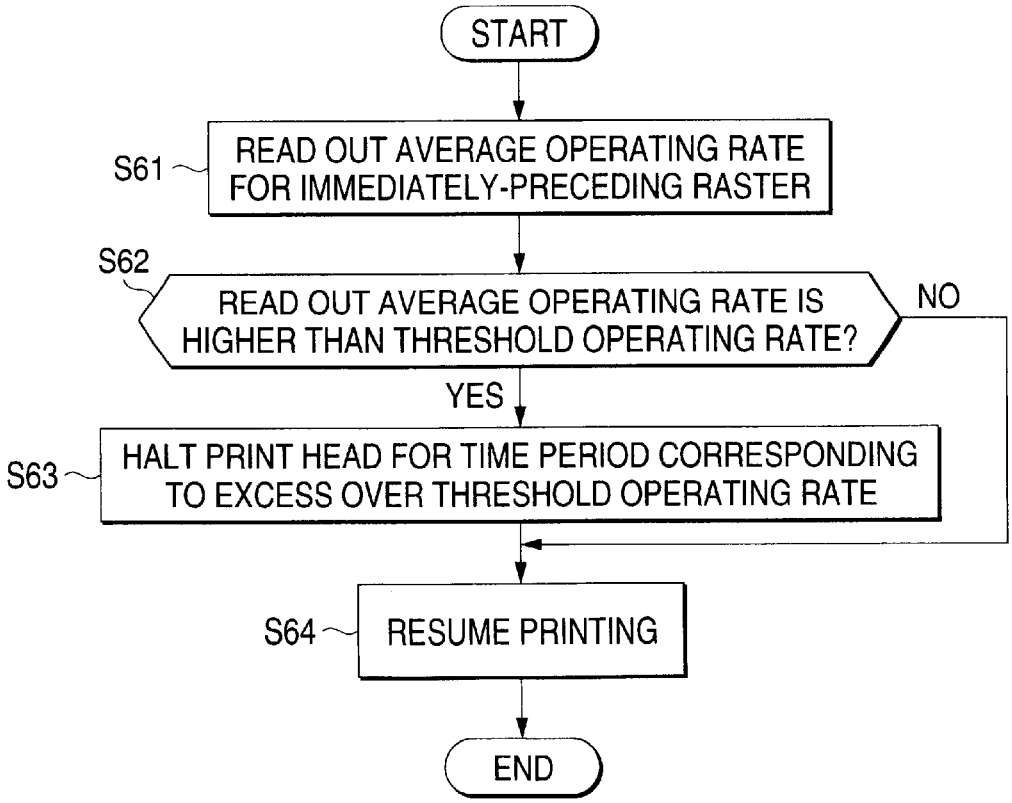
FIG. 6 is a flowchart showing processing operation of the respective functional blocks included in the processor shown in FIG. 2 according to an embodiment 1-2 of the invention.

FIG. 6 is a flowchart showing processing operations of individual functional blocks contained in the processor 19 shown in FIG. 2 according to an embodiment 1-2 of the invention. A flowchart shown in FIG. 6 is for the following operations. Namely, the dot counter 25 counts the number of ink droplets ejected onto print paper from each of the ink ejection nozzles of the print head 11, on a per-raster basis. An average operating rate determined from the count result is output to the operating rate comparator 31. The processing flow indicated by steps S61 through S64 shown in FIG. 6 differs from the processing flow shown in FIG. 4 in the following point. Specifically, an average operating rate determined by the dot counter 25 in step S61, an average operating rate to be compared with the threshold operating rate by the operating rate comparator 31 in step S62, and an average operating rate for which a difference with the threshold operating rate is to be computed in step S63 are determined not on a per-page basis but on a per-raster basis. In other respects, the processing flow is identical with that shown in FIG. 4, and hence repetition of its detailed explanation is omitted.

The preferred embodiment of the invention has been described thus far. However, the embodiment is an exemplification for describing the invention, and is not intended for limiting the scope of the invention solely to the embodiment. The invention can be implemented in other forms. For instance, temperature measurement devices, which detect an external ambient temperature; that is, the temperature of a room where the printer main unit 3 is disposed, and output a predetermined signal, are placed in locations within the room, as required. The threshold operating rate selector 29 selects from the table 90*a* threshold operating value commensurate with the detected room temperature as a new threshold operating rate. The thus-selected operating rate may be output to the threshold operating value comparison determination section 31.

In this case, the temperature (temperature range), including the normal temperature, eventually differs from the temperature (temperature range) used at the time of detection of the internal ambient temperature.

In order to detect the temperature of the power transistor, the thermistor 15 is attached to the power transistor and outputs to the threshold operating rate selector 29 a detection signal corresponding to a change in the temperature of the power transistor. As the table 90, there is adopted a table in which different threshold operating rates are set according to whether the temperature of the power transistor assumes a normal temperature or a temperature close thereto or falls within a temperature range higher than the normal temperature or a temperature range lower than the normal temperature. From the table, the threshold operating rate selector 29 may select a threshold operating rate commensurate with the detected temperature of the power transistor as a new threshold operating rate and output the thus-selected operating rate to the threshold operating rate comparator 31. In this case, in contrast with detection of the internal ambient temperature, in order to directly detect the temperature of the power transistor, the normal temperature is set to 100° C. or a value close thereto, and the critical temperature may be set to a value close to but less than 150° C.

In the embodiment, the dot counter 25 counts the number of ink droplets ejected onto print paper from respective ink ejection nozzles on a per-raster (per-line) basis at the time of printing of a single page (cut sheet), on a per-raster or per-page basis at the time of printing of a plurality of pages, or on a per-predetermined-number-of-pages basis at the time of printing of so-called continuous roll of paper. An average operating rate of the print head 11 has hitherto been determined from the count result. However, an average operating rate of the print head 11 may be determined not from the number of ink droplets but the amount of ink consumed.

No problem arises even if the host apparatus 1 in lieu of the processor 19 of the printer main unit 3 determines an average operating rate of the print head 11, compares the average operating rate with the threshold operating rate, and computes a halted time period of the print head 11 corresponding to the extent to which the average operating rate has exceeded the threshold operating rate.

Overheating of the power transistor may be prevented, by bringing the print head 11 into a standby condition every time the print head 11 performs one primary scanning operation.

A second embodiment of the invention will now be described. A print system including a printing apparatus and a host apparatus according to the second embodiment is substantially identical in basic configuration with that shown in FIG. 1. In the embodiment, the electrical resistance of the thermistor 15 is input to the temperature monitor by way of a transmission channel and is used as the temperature information described in connection with the invention.

Figure 7:
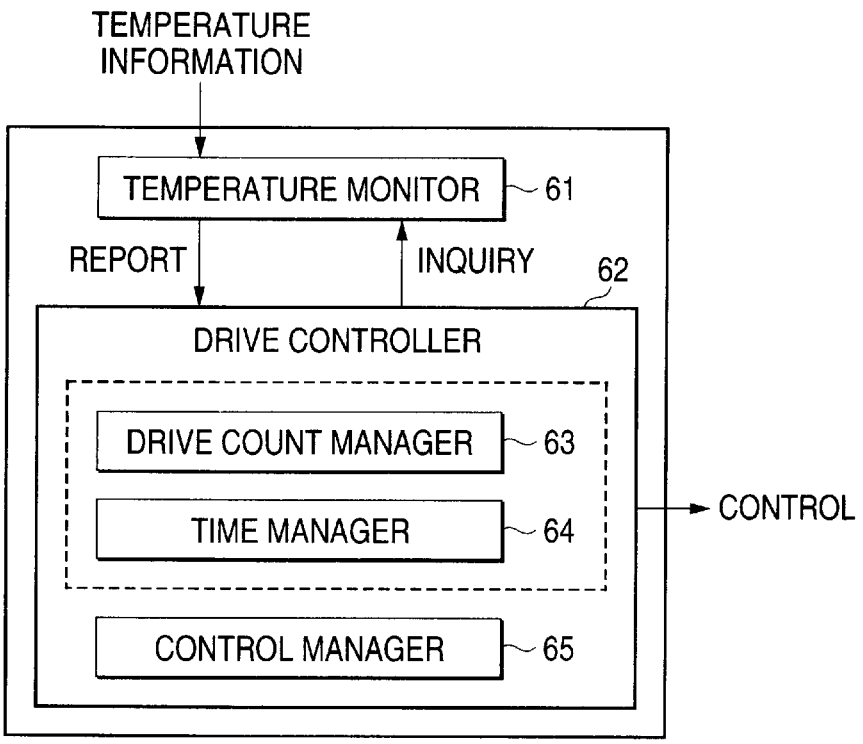
FIG. 7 is a control functional block diagram showing a second embodiment of the invention.

FIG. 7 is a block diagram showing the overview of functions for implementing a control operation through use of the temperature information. The functions are embodied as, for example, a PROM 44, a RAM 46, and a CPU 42 of the control circuit 10. The functions will be described by reference to drawings (i.e., FIGS. 8 through 17). The drawings include flowcharts for describing the nature of processing flow along which a temperature control operation is performed, and tables in which are recorded temperatures used for processing and control items in an associated manner.

Figure 8:
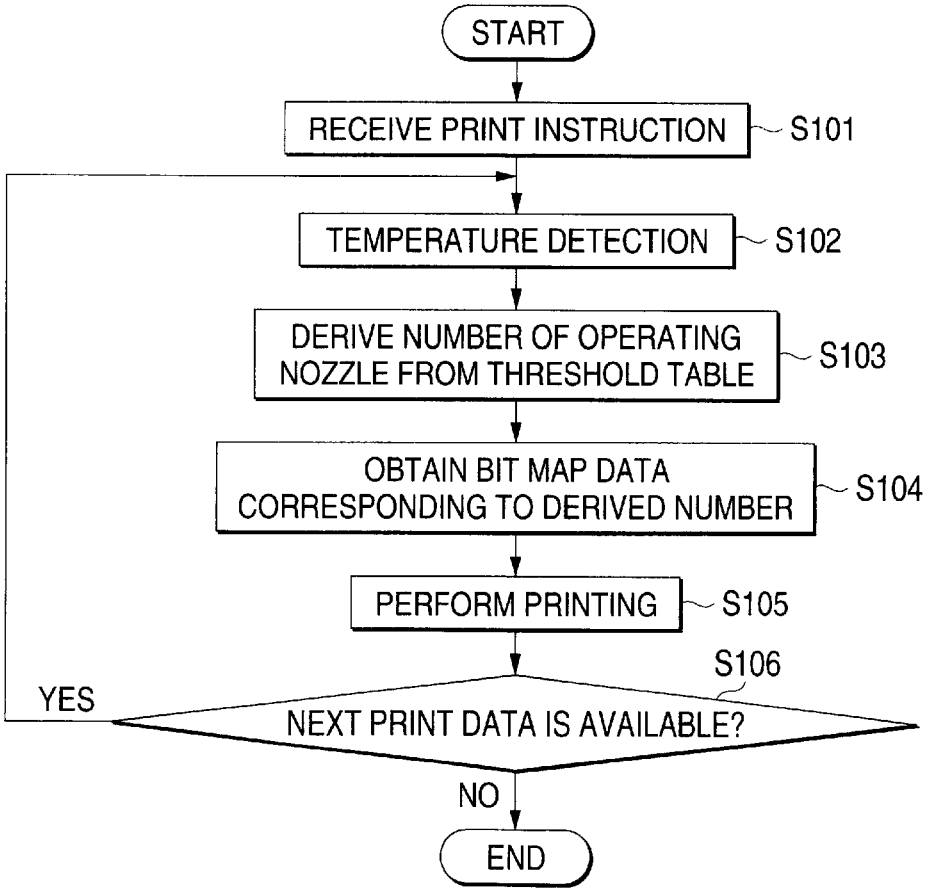
FIG. 8 is a flowchart showing processing operations of respective functional blocks shown in FIG. 7 according to an embodiment 2-1 of the invention.

FIG. 8 shows the basic processing flow employed when printing operation is continuously performed by carrying out a so-called dot omitting operation at the time of overheating of the power transistor (an embodiment 2-1). First, when the control circuit 10 shown in FIG. 1 has received a print instruction (step S101), the thermistor 15 detects a temperature. As shown in FIG. 7, a temperature monitor 61 is a functional block which monitors the temperature information detected by the thermistor 15. In response to an inquiry about temperature information from the drive controller 62, the temperature of the power transistor at that time is detected, and the thus-detected temperature is reported (step S102).

A control manager 65 stores a temperature and details of a control item in an associated manner. Information about the temperature and the control item, which are associated with each other, is recorded in the PROM 44 embodied as, e.g., hardware, in the form of a table 100 shown in FIG. 14. The control manager 65 reads the number of corresponding nozzles from the table 100 while the temperature reported to the temperature monitor 61 is taken as key information (step S103). For instance, when the reported temperature of the power transistor is 85° C., 144 nozzles are derived. In this case, subsequent printing operation is performed through use of 144 nozzles, which represent half the total of 288 nozzles. To this end, processing is performed on the assumption that a head having 144 nozzles (i.e., 24 nozzles for each color) is used when information is developed into a bitmap for subsequent buffers to be described later (steps S104, S105). In this case, for example, nozzles are used such that an operating nozzle and a non-operating nozzle are alternately arranged.

For instance, when the reported temperature of the power transistor is 65° C., 240 nozzles are derived. In this case, subsequent processing operation is performed through use of 240 nozzles from among a total of 288 nozzles for six colors. In this case, 48 nozzles are assigned to each color. For example, 40 nozzles are used for each color, wherein four nozzles are excluded from upper and lower rows of nozzles. In this case, there is no necessity for using 40 nozzles of each color group of nozzles. For instance, in the case of six color groups of nozzles: e.g., cyan (C), magenta (M), yellow (Y), light cyan (LC), light magenta (LM), and black (K), the number of nozzles to be used may differ from one color nozzle group to another color nozzle group; e.g., 40 nozzles of C, 20 nozzles of M, 60 nozzles of Y, 10 nozzles of LC, 50 nozzles of LM, and 60 nozzles of K. Thus, a total of 240 nozzles may be used. In this case, the number of nozzles to be used may be stored beforehand for each color nozzle row in memory (e.g., the PROM 44 or the like). Alternatively, the number of nozzles may be determined in real time as occasion requires.

After printing of all data sets included in the print instruction has been completed, processing is terminated (when NO is selected in step S106).

Figure 9:
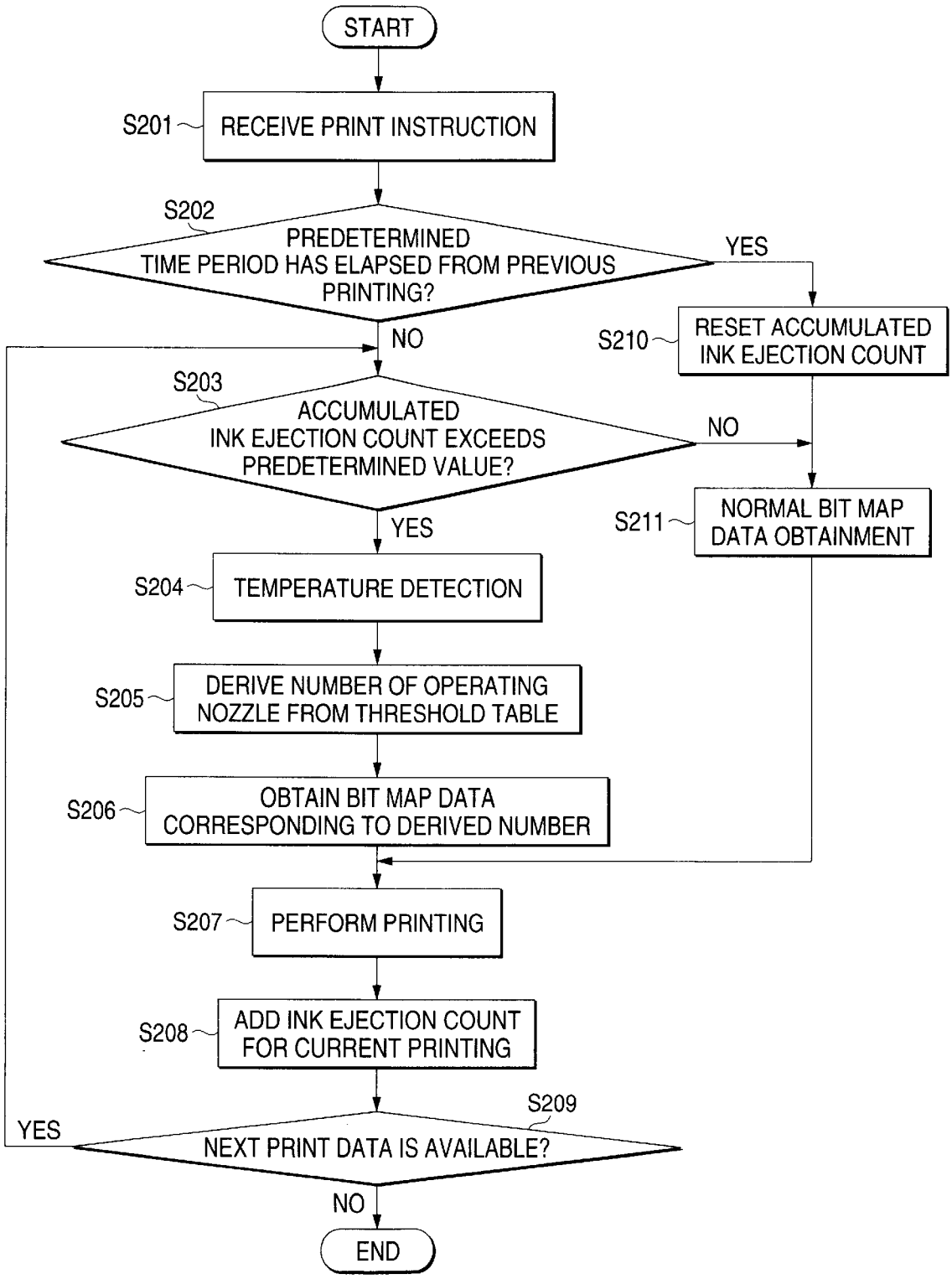
FIG. 9 is a flowchart showing processing operations of respective functional blocks shown in FIG. 7 according to an embodiment 2-2 of the invention.

FIG. 9 is a flowchart for describing an example in which processing proceeds to the above-described processing after performance of an evaluation as to whether or not a dot omitting operation is actually required, on the basis of a nozzle operation in the past (an embodiment 2-2). The evaluation operation is performed by a functional block group (i.e., past operation evaluator) enclosed by dashed lines within the drive controller 62 shown in FIG. 7.

When the print instruction has been received (step S201), a time manager 64 checks a time period which has elapsed since a previous printing operation was performed (step S202). If a considerable time period has elapsed since a previous printing operation was performed, the heat stemming from activation of nozzles in the past has already been dissipated, and there is no necessity for taking it into consideration. Hence, the number of times the nozzles have been activated stored in a drive count manager 63 is reset, and a normal printing operation is carried out (steps S210, 211, and 207).

When a print instruction is received within a given time period since the previous printing operation was performed, there is performed an evaluation as to whether or not a dot omitting operation is actually required, on the basis of the accumulated number of times the nozzles have been activated in the past at the time of actuation of the print head (step S203). More specifically, temperature detection is performed only when the total number of times ink has been ejected, the number being cumulatively recorded in the drive count manager 63, exceeds a predetermined value. Subsequently, there is performed processing identical with that described previously (steps S204 through S207).

Even when the value stored in the drive count manager 63 is small, a printing operation is performed by a normal printing method; that is, through use of all nozzles (step S211 and subsequent steps). In any event, heat stems from execution of printing operation. Hence, the drive count manager 63 adds a count value to an accumulated number of times nozzles have been activated (step S208). The accumulated number is taken as a material to be used in rendering a determination when the next printing operation is performed.

Figure 10:
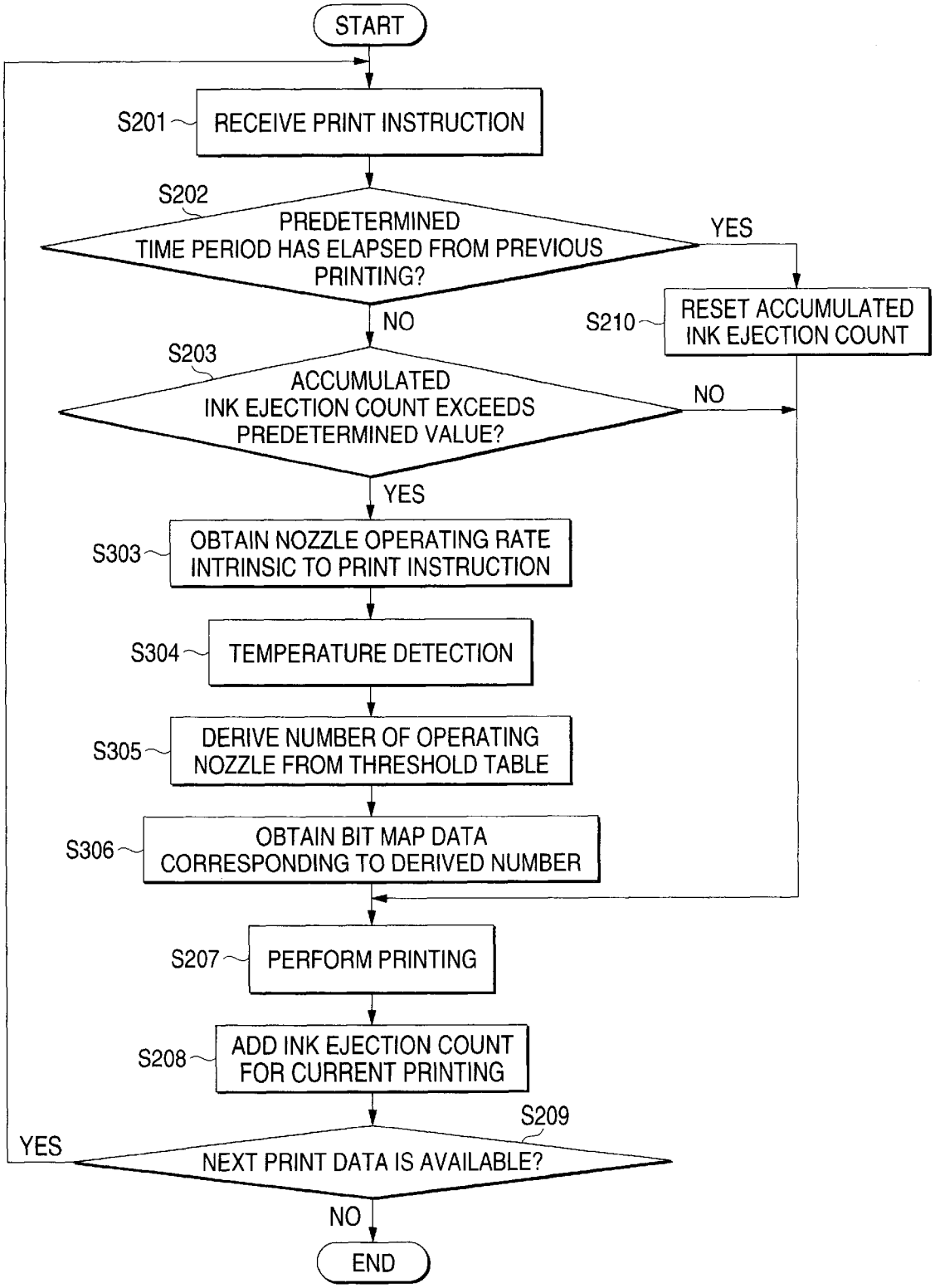
FIG. 10 is a flowchart showing processing operations of respective functional blocks shown in FIG. 7 according to an embodiment 2-3 of the invention.

FIG. 10 is a flowchart for describing procedures for predicting and evaluating the amount of heat stemming from a printing operation which is to be performed, in addition to the above described processing (an embodiment 2-3). Namely, the drive count manager 63 checks the number of nozzles to be activated which is intrinsic to the bit map data represented by the print instruction (step S303).

In the processing, the control manager 65 determines a degree to which a nozzle operating rate is to be diminished when an actual printing operation is performed, while the temperature information read from a table 300 shown in FIG. 16 is taken as first key information and while a nozzle operating rate intrinsic to a print instruction which is to be executed is taken as second key information (steps S303 to S305). For example, when the detected temperature of the power transistor is 85° C. and print sample data involving a nozzle operating rate of 130% are to be printed from this point, image processing assumed to involve use of 198 nozzles is performed (step S306).

According to such a configuration, the operating rate can be diminished more finely. More specifically, in the previously-described example, the number of nozzles is reduced to half, regardless of contents of an image which is to be printed from this point. In contrast, a printing operation can be performed to the end at a low rate of decrease.

A nozzle operating rate should not be reduced during the course of the printer causing the carriage to perform scanning operation. For example, conversion of image information into a bitmap is renewed at a point in time when the carriage has returned to its home position or when printing for one page has been completed.

There has been described a configuration in which the print head is actuated by reducing the nozzle operating rate. There will now be described a configuration in which the print head is halted for only an appropriate time period in accordance with the detected temperature of the power transistor.

Figure 11:
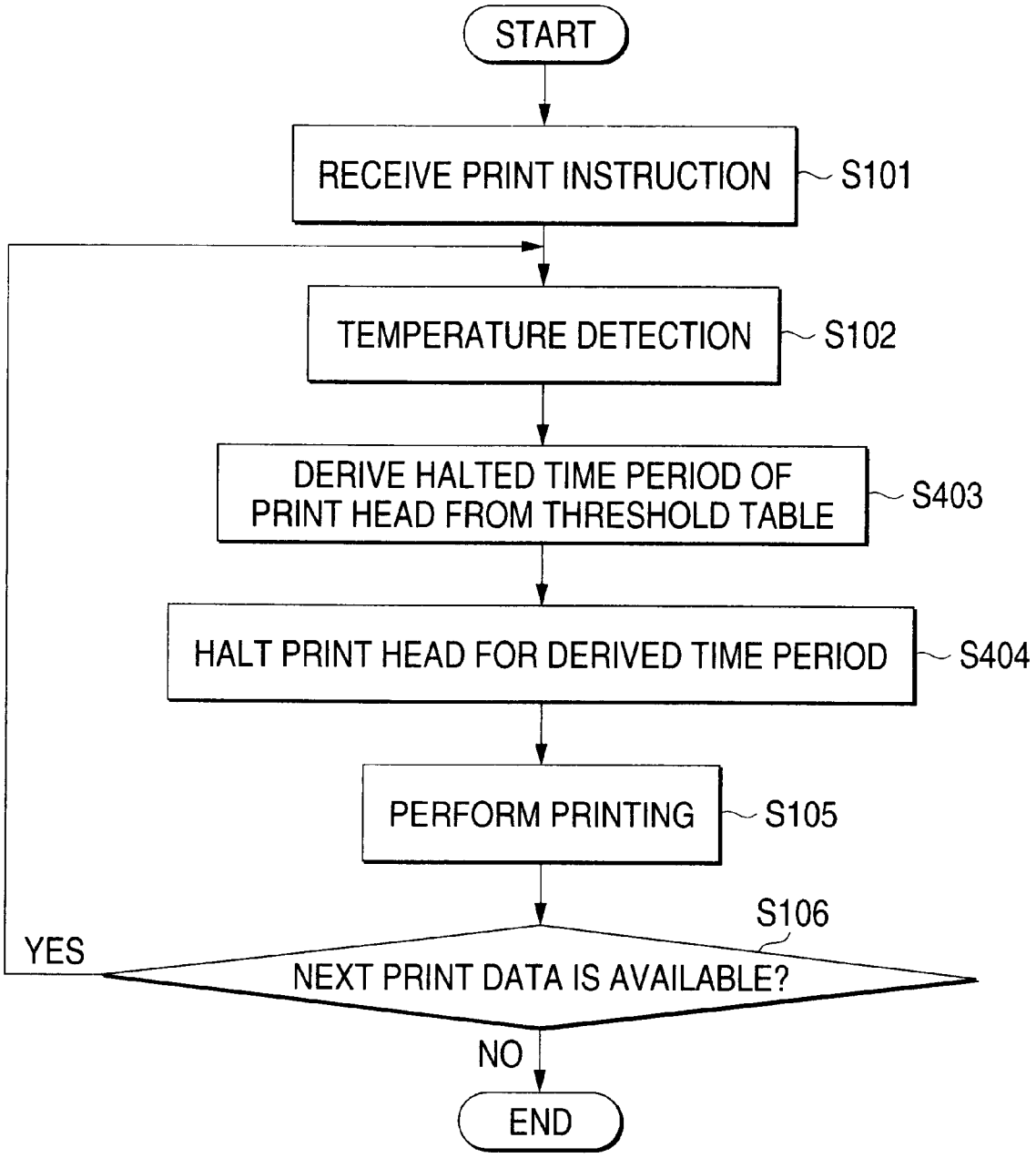
FIG. 11 is a flowchart showing processing operations of respective functional blocks shown in FIG. 7 according to an embodiment 2-4 of the invention.

FIG. 11 shows a flowchart for describing the most basic procedures in connection with that configuration (an embodiment 2-4). According to the procedures, the drive controller 62 that has received a report about a detected temperature from the temperature monitor 61 determines a time period during which the print head is to be halted, by reference to a table 200 (see FIG. 15) stored by the control manager 65 (step S403). For example, when the temperature of the power transistor is 85° C., the print head is halted for a period of 0.80 seconds (step S404).

Figure 12:
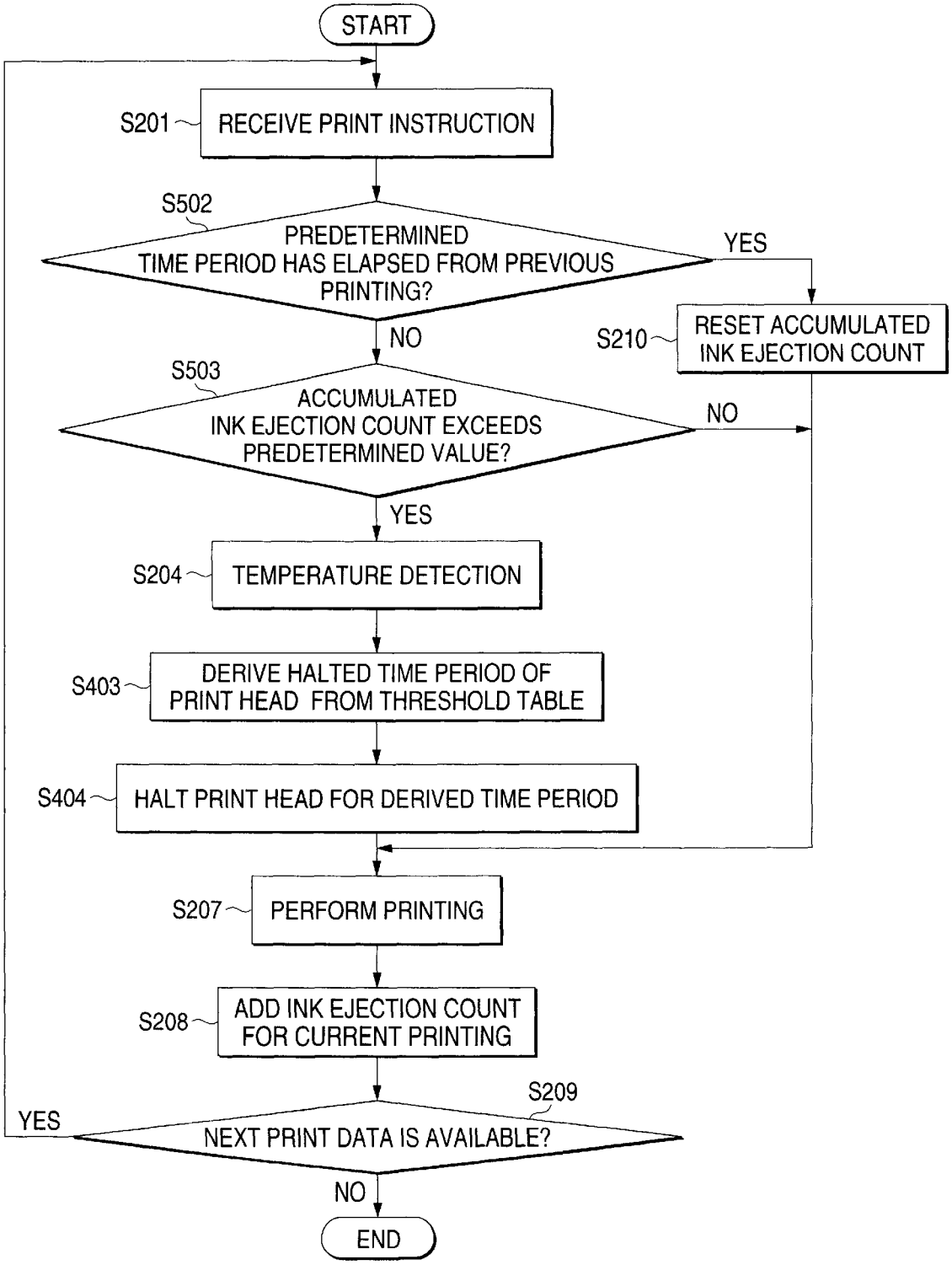
FIG. 12 is a flowchart showing processing operations of respective functional blocks shown in FIG. 7 according to an embodiment 2-5 of the invention.

FIG. 12 is a view for describing a processing flow employed when the drive controller 62 has the foregoing past operation evaluator (an embodiment 2-5). The past operation evaluator has the function of determining whether or not operation of nozzles is to be suspended when a printing operation is performed, on the basis of the past nozzle operation. In this case, the time manager 64 first makes a determination as to whether or not a predetermined time period has elapsed since the previous printing operation was performed (step S502). Next, the drive count manager 63 determines the accumulated number of times nozzles have been activated in the past (step S503).

Figure 13:
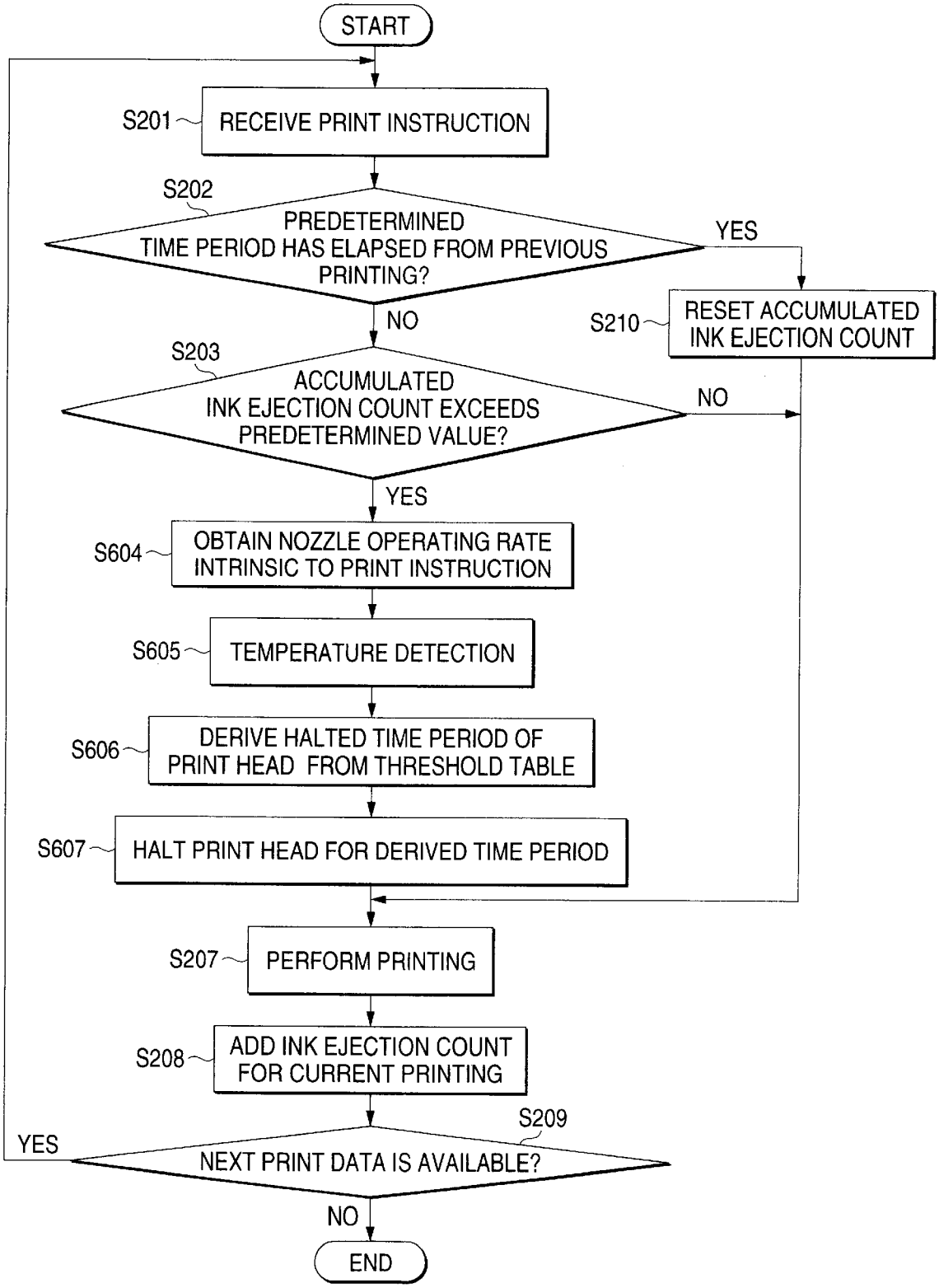
FIG. 13 is a flowchart showing processing operations of respective functional blocks shown in FIG. 7 according to an embodiment 2-6 of the invention.

FIG. 13 is a flowchart for describing procedures for predicting and evaluating the amount of heat stemming from a printing operation which is to be performed, in addition to the above described processing (an embodiment 2-6). Even in this case, the drive count manager 63 checks the number of nozzles to be activated intrinsic to the bit map data represented by the print instruction (step S604).

Even in the processing, the control manager 65 determines a time period during which a printing operation is to be actually halted, while the temperature information read from a table 400 shown in FIG. 17 is taken as first key information and while a nozzle operating rate intrinsic to a print instruction which is to be executed is taken as second key information (steps S604 to S606). Even in this case, the print head should preferably not halted during the course of scanning operation of the print head.

The second embodiment has been described. The functions of the printing apparatus according to the invention may be embodied by any hardware configuration. When the drive count manager 63 and the time manager 64 evaluate a past nozzle operation, the sequence in which the drive count manager 63 and the time manager 64 perform evaluation does not need to be identical with that shown in the embodiment.

In the second embodiment, as shown in FIG. 16, there are provided non-driven nozzles (i.e., a nozzle operating rate is adjusted) according to the detected temperature of the power transistor. Alternatively, as shown in FIG. 17, operation of the head is halted for a given time period. As a matter of course, it is also conceivable to provide non-driven nozzles or halt operation of the print head for a given time period according to the detected temperature of the power transistor.

A third embodiment of the invention will now be described. This embodiment is basically based on the functional blocks shown in FIG. 2 in connection with the first embodiment. Further, the table stored by the table storage 27 includes tables shown in FIGS. 14 through 17 in connection with the second embodiment.

Figure 18:
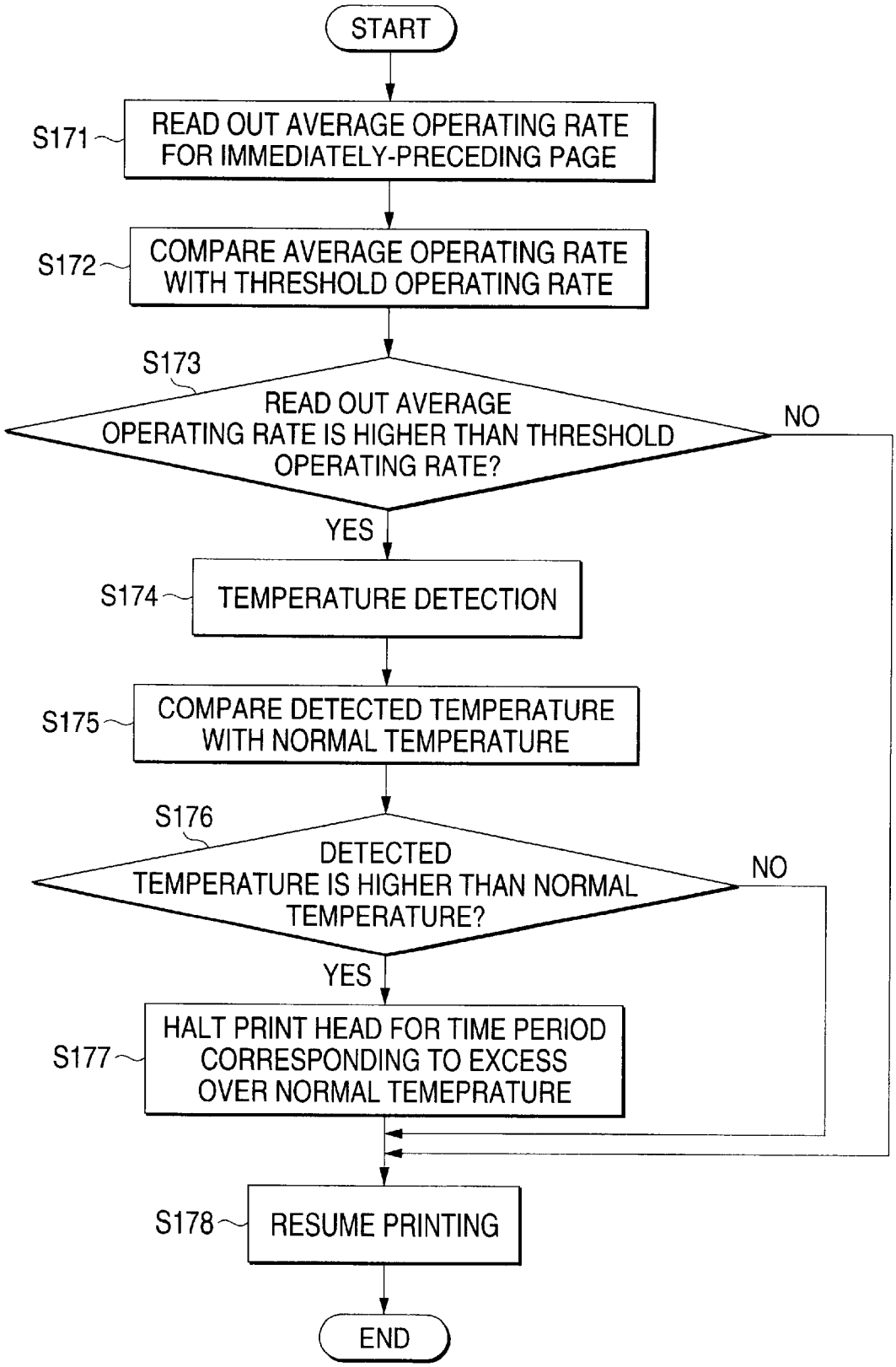
FIG. 18 is a flowchart showing processing operation effected in an embodiment 3-1 of the invention.

FIG. 18 is a flowchart showing a processing operation according to an embodiment 3-1 of the invention. According to the flowchart shown in FIG. 18, the dot counter 25 counts the number of ink droplets ejected onto the immediately-preceding page of print paper from each of the ink ejection nozzles of the print head 11. An average operating rate (duty factor) determined from the count result is output to the operating rate comparator 31, and a temperature is detected. In accordance with a detected temperature, the time during which the print head 11 is to be halted is adjusted.

As shown in FIG. 18, the dot counter 25 counts the number of ink droplets ejected onto the immediately-preceding page of print paper from each of the ink ejection nozzles of the print head 11. From the count result, an average duty factor of the immediately-preceding page is computed (step S171). The operating rate comparator 31 reads an average duty factor of the immediately-preceding page determined by the dot counter 25. The thus-read average duty factor is compared with the threshold operating rate (i.e., normalized value data) read from the threshold table storage 27 by way of the threshold operating rate selector 29 (step S172). As a result of comparison, a determination is made as to whether or not an average duty factor of the immediately-preceding page is greater than the standard value data (step S173). When the average duty factor of the immediately-preceding page is greater than the normalized value data (when YES is selected in step S173), a temperature is detected at this time. More specifically, the thermistor 15 attached to the heat sink of the power transistor outputs a detection signal corresponding to a change in the temperature of the heat sink to the threshold operating rate selector 29. The temperature detection signal output from the thermistor 15 is read, thereby ascertaining the internal ambient temperature (step S174). Subsequently, the operating rate comparator 31 compares the temperature with the normal temperature (normalized value) (step S175). As a result of comparison, a determination is made as to whether or not the detected temperature is higher than the normalized value (step S176). When the detected temperature is higher than the normalized value (when YES is selected in step S176), a time into which a difference between the detected temperature and the normalized value has been converted is taken as a halted time period for the print head 11 (step S177). If the halted time period is longer than a standby time period required for feeding paper, operation of the print head 11 is resumed at a point in time when the halted time period has elapsed (step S178). In contrast, if the halted time period is shorter than the standby time period required for feeding paper or if a time required for replenishing a paper feeding tray with paper due to a paper empty state (i.e., a replenishment time) or a time required for awaiting image data from the host apparatus 1 (i.e., a standby time period), either time being longer than the halted time period, overlaps the halted time period, operation of the print head 11 is resumed after lapse of the halted time period and subsequent lapse of the replenishment or standby time period (step S178). If in step S176 the normal temperature (standard value) is higher than the detected temperature (when NO is selected in step S176), operation of the print head 11 is resumed immediately (step S178). If in step S173 the average duty factor of the immediately-preceding page is greater than the threshold operating rate (standard data) (when NO is selected in step S173), operation of the print head 11 is resumed immediately in a like manner (step S178).

In steps 171 through 173, the dot counter 25 counts the number of ink droplets ejected onto the immediately-preceding page of print paper from the ink ejection nozzles of the print head 11. An average operating rate (i.e., a duty factor) determined from the count result is output to the operating rate comparator 31, and a temperature is detected. A time during which the print head 11 is to be halted may be adjusted in accordance with a detected temperature.

Figure 19:
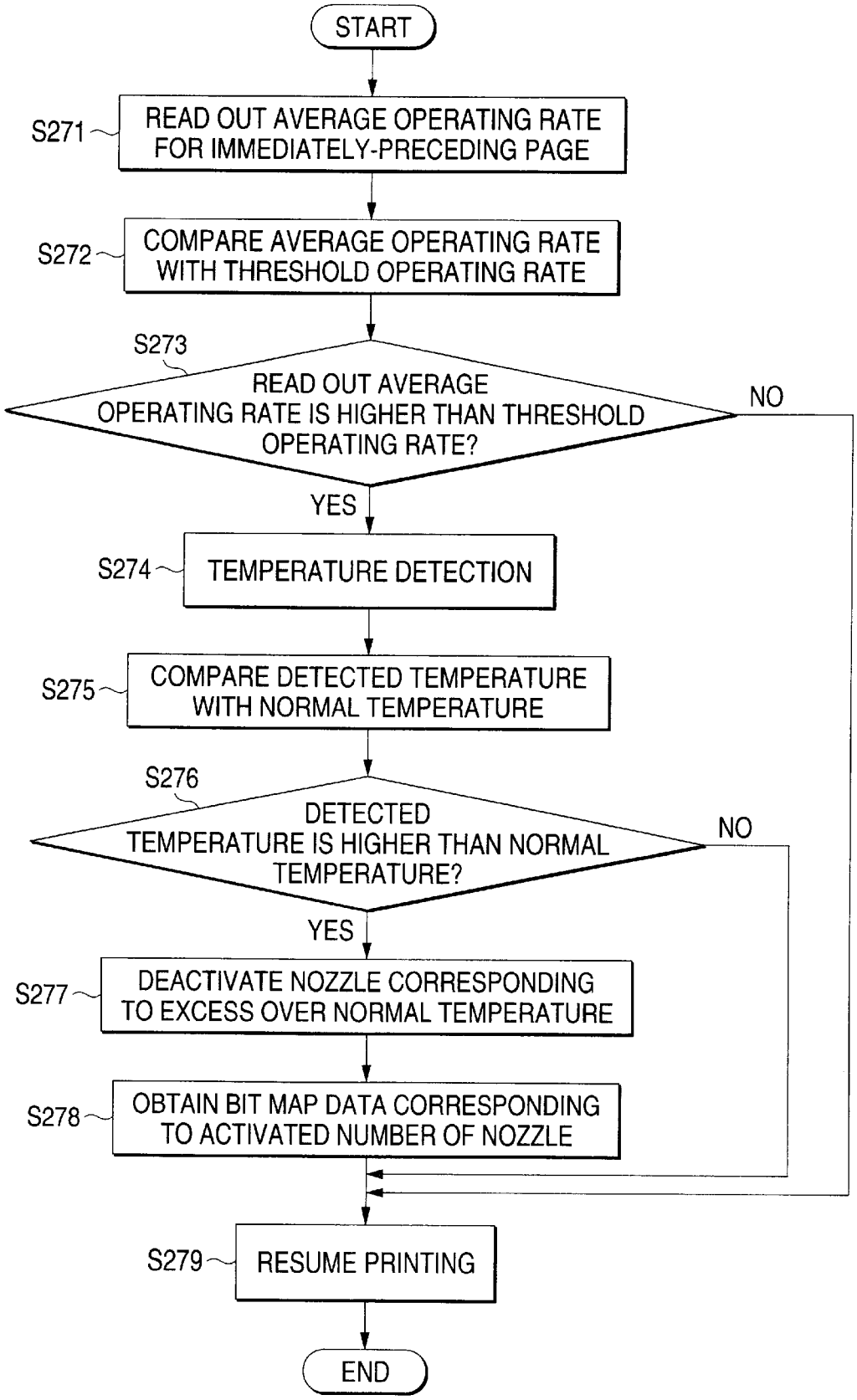
FIG. 19 is a flowchart showing processing operation effected in an embodiment 3-2 of the invention.

Steps S271 through S276 shown in FIG. 19 are completely identical with steps S171 through S176 shown in FIG. 18 in connection with the embodiment 3-1. In the embodiment 3-2, a determination is made as to whether or not the detected temperature is higher than the standard value (step S276). When the detected temperature is higher than the standard value (when YES is selected in step S276), there are set inoperative nozzles corresponding to the number of nozzles into which a difference between the detected temperature and the standard value has been converted (step S277). When information is converted into a bitmap data for subsequent image buffers, processing is performed on the basis of the number of remaining nozzles determined by subtracting the number of inoperative nozzles from the total number of nozzles (step S278). Then, printing is resumed (step S279), and processing is terminated.

In steps S271 through 273, the dot counter 26 counts the number of ink droplets ejected onto the immediately-preceding raster (line) on print paper from the ink ejection nozzles of the print head 11. An average operating rate (i.e., a duty factor) determined from the count result is output to the operating rate comparator 31, and a temperature is detected. The nozzle operating rate of the print head 11 may be adjusted in accordance with the detected temperature.

Figure 20:
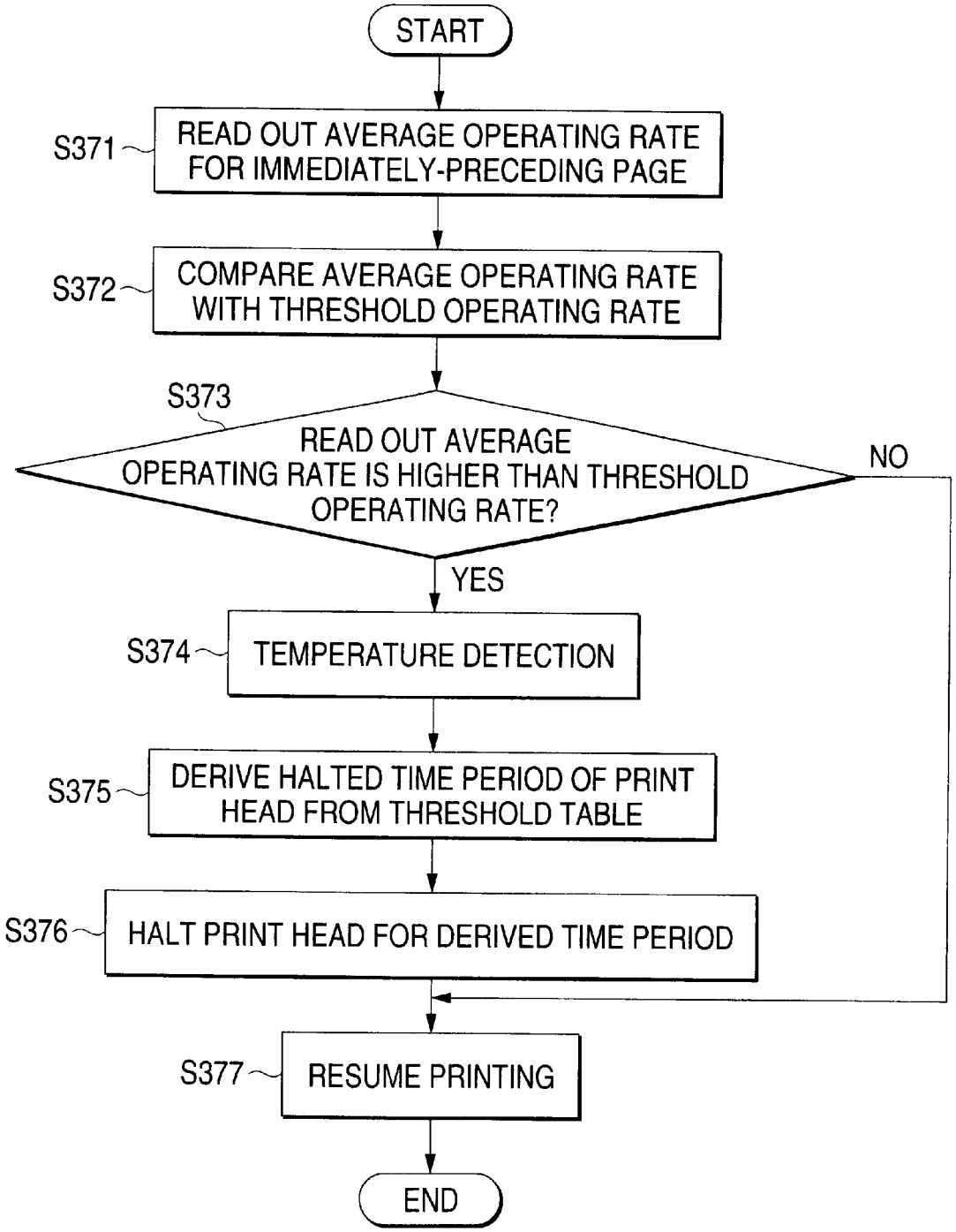
FIG. 20 is a flowchart showing processing operation effected in an embodiment 3-3 of the invention.

FIG. 20 shows a flowchart showing processing operation in connection with an embodiment 3-3 of the invention. According to the flowchart shown in FIG. 20, when the average operating rate (i.e., a duty factor) of the immediately-preceding page is greater than the standard value, a predetermined halted time period is acquired from a predetermined table according to a detected temperature, in the same manner as in the case shown in FIG. 18 in connection with the embodiment 3-1. Operation of the print head 11 is halted for only the period of the halted time period.

Steps S371 through S374 shown in FIG. 20 are completely identical with steps S171 through S174 shown in FIG. 18 in connection with the embodiment 3-1. In the embodiment 3-3, when a temperature has been detected (step S374), a halted time period corresponding to the thus-detected temperature is acquired from the table 200 (see FIG. 15) (step S375), and operation of the print head 11 is halted for only the period of halted time period (step S376). With lapse of the time, heat generated from the power transistor of the print head 11 is sufficiently dissipated. Hence, printing is resumed (step S377), and processing is terminated.

In steps S371 through S373, the number of ink droplets formed on the immediately-preceding line (raster) may be counted. If an average operating rate (duty factor) of the immediately-preceding line is greater than the standard value, a temperature is detected. A predetermined halted time period may be acquired from a predetermined table according to the detected temperature. It may be the case that operation of the print head 11 is halted for only the period of halted time period.

Figure 21:
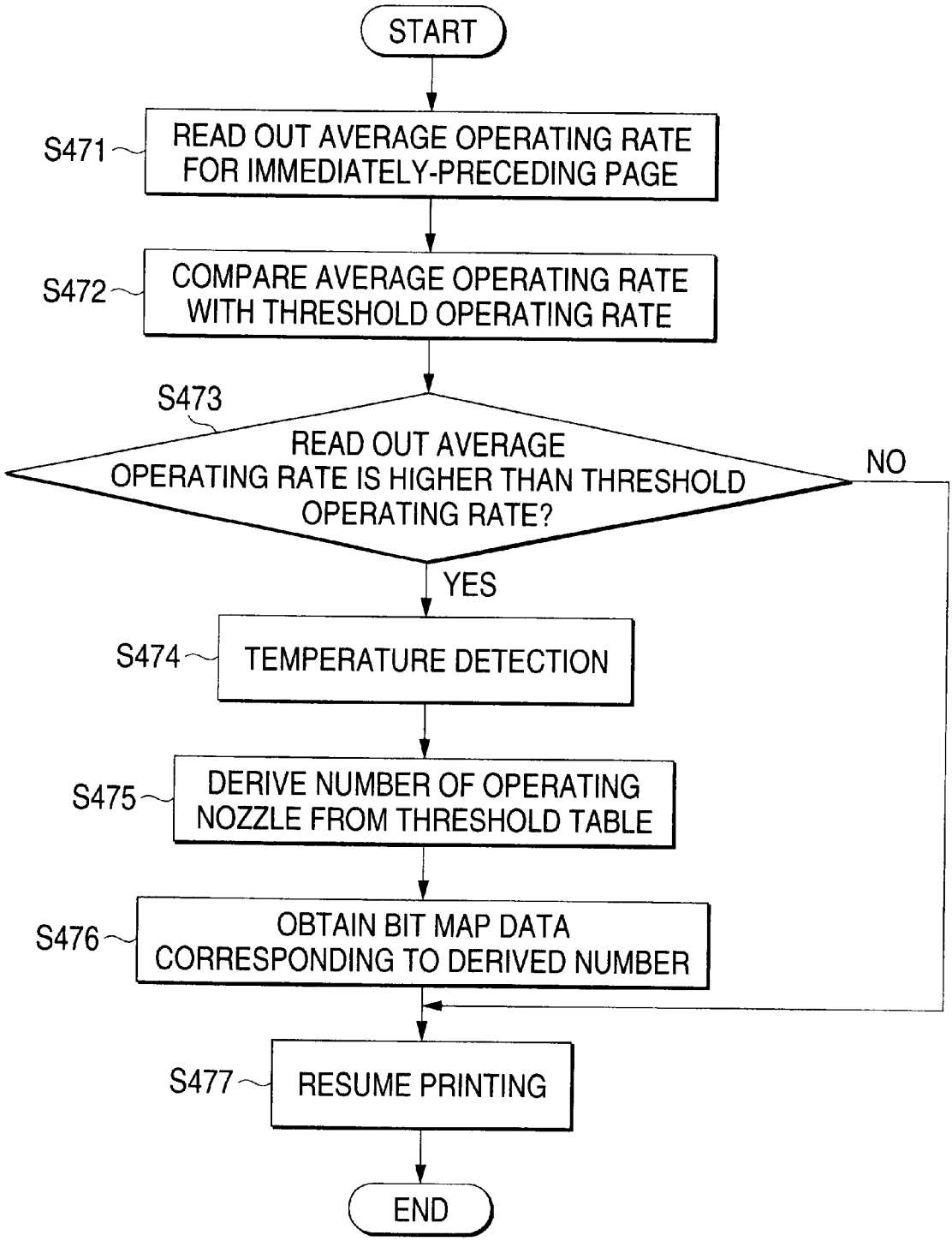
FIG. 21 is a flowchart showing processing operation effected in an embodiment 3-4 of the invention.

FIG. 21 is a flowchart showing processing operation in connection with an embodiment 3-4 of the invention. According to the flowchart shown in FIG. 21, when the average operating rate (duty factor) of the immediately-preceding page is greater than the standard value, a temperature is detected in the same manner as in the case shown in FIG. 20 in connection with the embodiment 3-3. A predetermined number of nozzles is acquired from the predetermined table according to the detected temperature, and the nozzle operating rate of the print head 11 is adjusted in accordance with the number of nozzles.

As shown in FIG. 21, steps S471 through S474 are completely identical with steps S371 through S374 shown in FIG. 20 in connection with the embodiment 3-3. In the embodiment 3-4, after a temperature has been detected (step S474), the number of nozzles corresponding to the thus-detected temperature is acquired from the table 100 (see FIG. 14) (step S475). When information is converted into a bit map data for subsequent image buffers, processing is performed on the basis of assumption of the number of nozzles acquired from the table 100 (step S476). As a result, heat which would otherwise develop in the power transistor of the print hood 11 from that point is suppressed, hence printing is resumed (step S477), and processing is terminated.

In steps 471 through 473, the number of ink droplets formed on an immediately-preceding line (raster) may be counted. When an average operating rate (duty factor) of the immediately-preceding line is greater than the standard value, a temperature is detected. A predetermined number of nozzles is acquired from a predetermined table according to the detected temperature. In accordance with the thus-acquired number of nozzles, the nozzle operating rate of the print head 11 may be adjusted.

Figure 22:
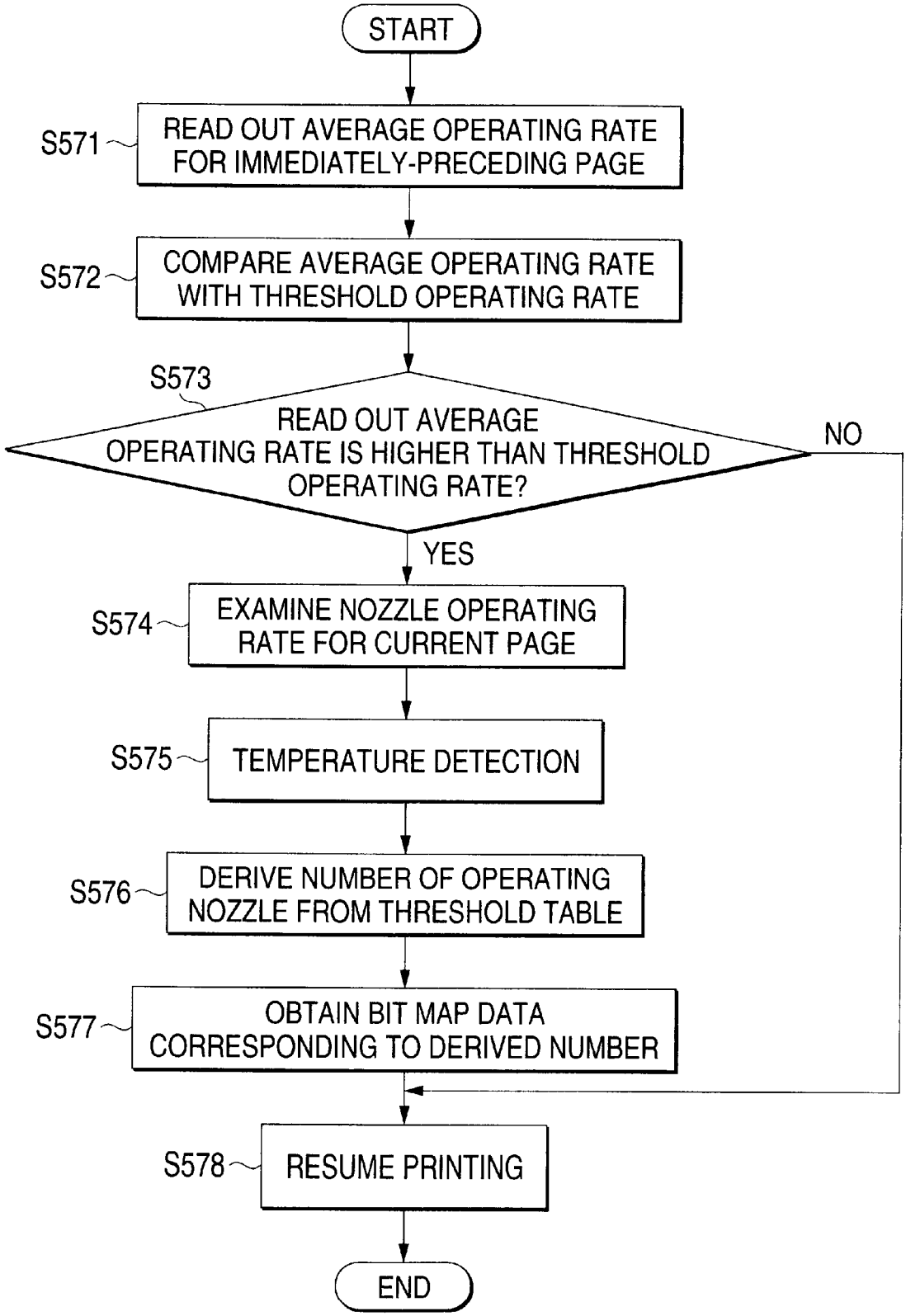
FIG. 22 is a flowchart showing processing operation effected in an embodiment 3-5 of the invention.

FIG. 22 is a flowchart showing processing operation in connection with an embodiment 3-5 of the invention. According to the flowchart shown in FIG. 22, an average operating rate. (duty factor) of the immediately-preceding page is compared with standard value data, as in the case of the flowchart shown in FIG. 21 in connection with the embodiment 3-4. When the average operating rate (duty factor) of the immediately-preceding page is greater than the standard value, a nozzle operating rate for the current page is examined. Thereafter, a temperature is detected. A predetermined number of nozzles is acquired from a predetermined table in accordance with the nozzle operating rate of the current page and the detected temperature. The nozzle operating rate of the print head 11 is adjusted in accordance with the number of nozzles.

Steps S571 through S573 shown in FIG. 22 are completely identical with steps S471 through S473 shown in FIG. 21 in connection with the embodiment 3-4. In an embodiment 3-5, when the average operating rate (duty factor) of the immediately-preceding page is greater than the standard value (when YES is selected in step S573), the nozzle operating rate of the current page is examined (S574). Then, a temperature is detected (step S575), and the number of nozzles corresponding to the nozzle operating rate of the current page and to the detected temperature is acquired from a table 300 (see FIG. 16) (step S576). When information is converted into a bitmap data for subsequent image buffers, processing is performed on the basis of the assumption of use of a head having nozzles in the number acquired from the table 300 (step S577). Here, the table 300 shown in FIG. 16 is referred to in connection with the second embodiment. Here, the "nozzle operating rate intrinsic to print data" shown in the table 300 in FIG. 16 is regarded as "nozzle operating rate for a current page." As a result, heat which is to be generated in the power transistor in the print head 11 is inhibited, and hence printing is resumed (step S578). Processing is then terminated.

In steps S571 through S573, the number of ink droplets formed on an immediately-preceding line (raster) may be counted. When an average operating rate (duty factor) of an immediately-preceding line is greater than standard value, a temperature is detected after a nozzle operating rate for a current line has been detected. According to a nozzle operating rate for a current line and a detected temperature, a predetermined number of nozzles is acquired from a predetermined table. A nozzle operating rate of the print head 11 may be adjusted in compliance with the number of nozzles.

Figure 23:
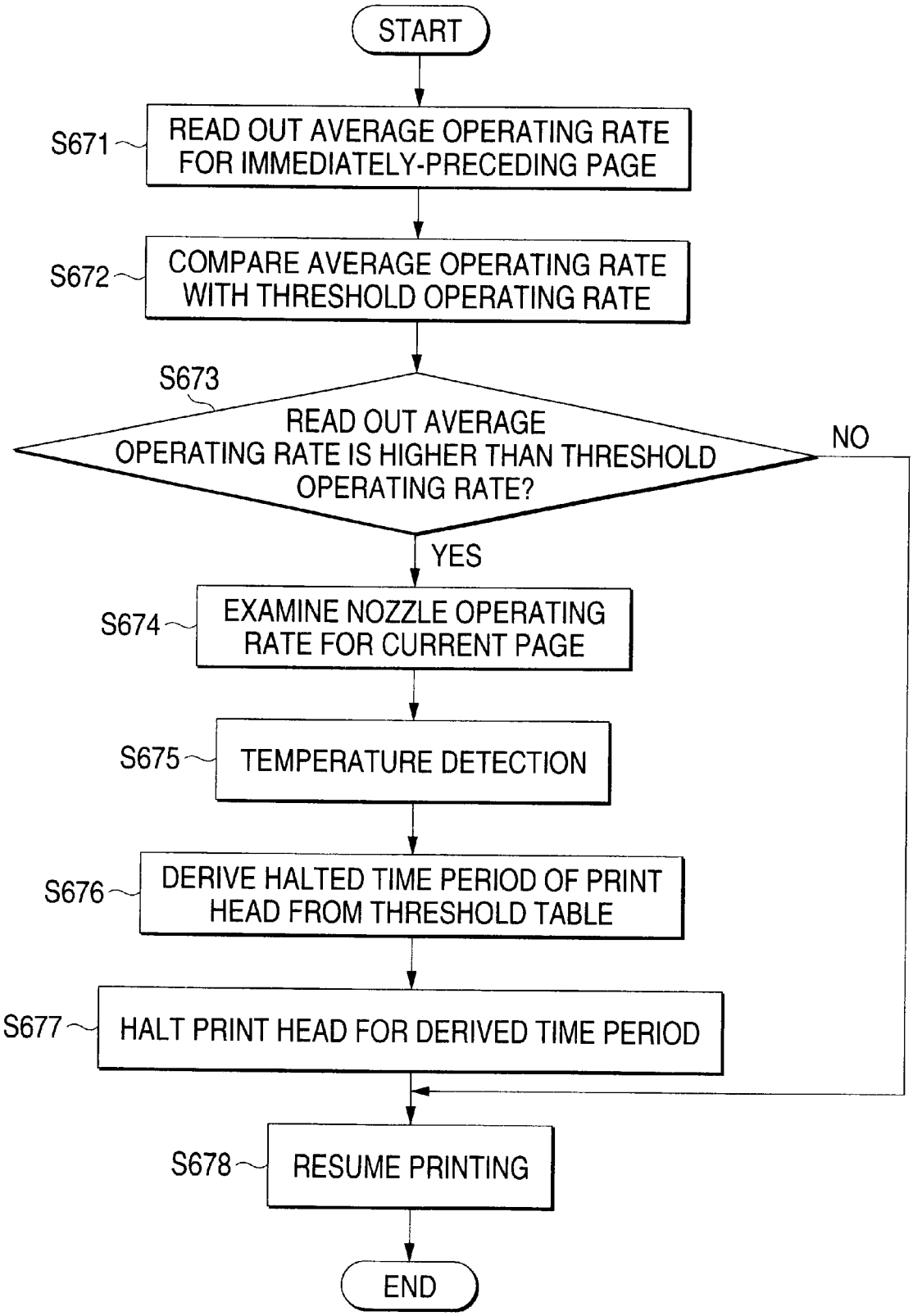
FIG. 23 is a flowchart showing processing operation effected in an embodiment 3-6 of the invention.

FIG. 23 is a flowchart showing processing operation in connection with an embodiment 3-6 of the invention. According to the flowchart shown in FIG. 23, an average operating rate (duty factor) of the immediately-preceding page is compared with standard value data, as in the case of the flowchart shown in FIG. 22 in connection with the embodiment 3-5. When the average operating rate (duty factor) of the immediately-preceding page is greater than the standard value, a nozzle operating rate for the current page is examined. Thereafter, a temperature is detected. A predetermined halted time period may be acquired from a predetermined table according to the nozzle operating rate for the current page and the detected temperature. Operation of the print head 11 is halted for only the period of halted time period.

Steps S671 through S673 shown in FIG. 23 are completely identical with steps S571 through S573 shown in FIG. 22 in connection with the embodiment 3-5. In an embodiment 3-6, when the average operating rate (duty factor) of the current page has been examined (step S674), a temperature is detected (step S675). A halted time period corresponding to the nozzle operating rate for the current page and the detected temperature is acquired from a table 400 (see FIG. 17) (step S676). Operation of the print head 11 is halted for only the period of halted time period (step S677). Here, the table 400 shown in FIG. 17 is referred to in connection with the second embodiment. Here, the "nozzle operating rate intrinsic to print data" shown in the table 300 in FIG. 16 is regarded as "nozzle operating rate for a current page." As a result of lapse of the time, heat generated from the power transistor in the print head 11 is sufficiently dissipated, and hence printing is resumed (step S678). Processing is then terminated.

In steps S671 through S673, the number of ink droplets formed on the immediately-preceding line may be counted. If an average operating rate (duty factor) of the immediately-preceding line is greater than the standard value data, a temperature is detected after a nozzle operating rate for the current line has been examined. A predetermined halted time period is acquired from a predetermined table in accordance with the nozzle operating rate for the current line and the detected temperature. It may be arranged that operation of the print head 11 is halted for only the period of halted time period.

Figure 24:
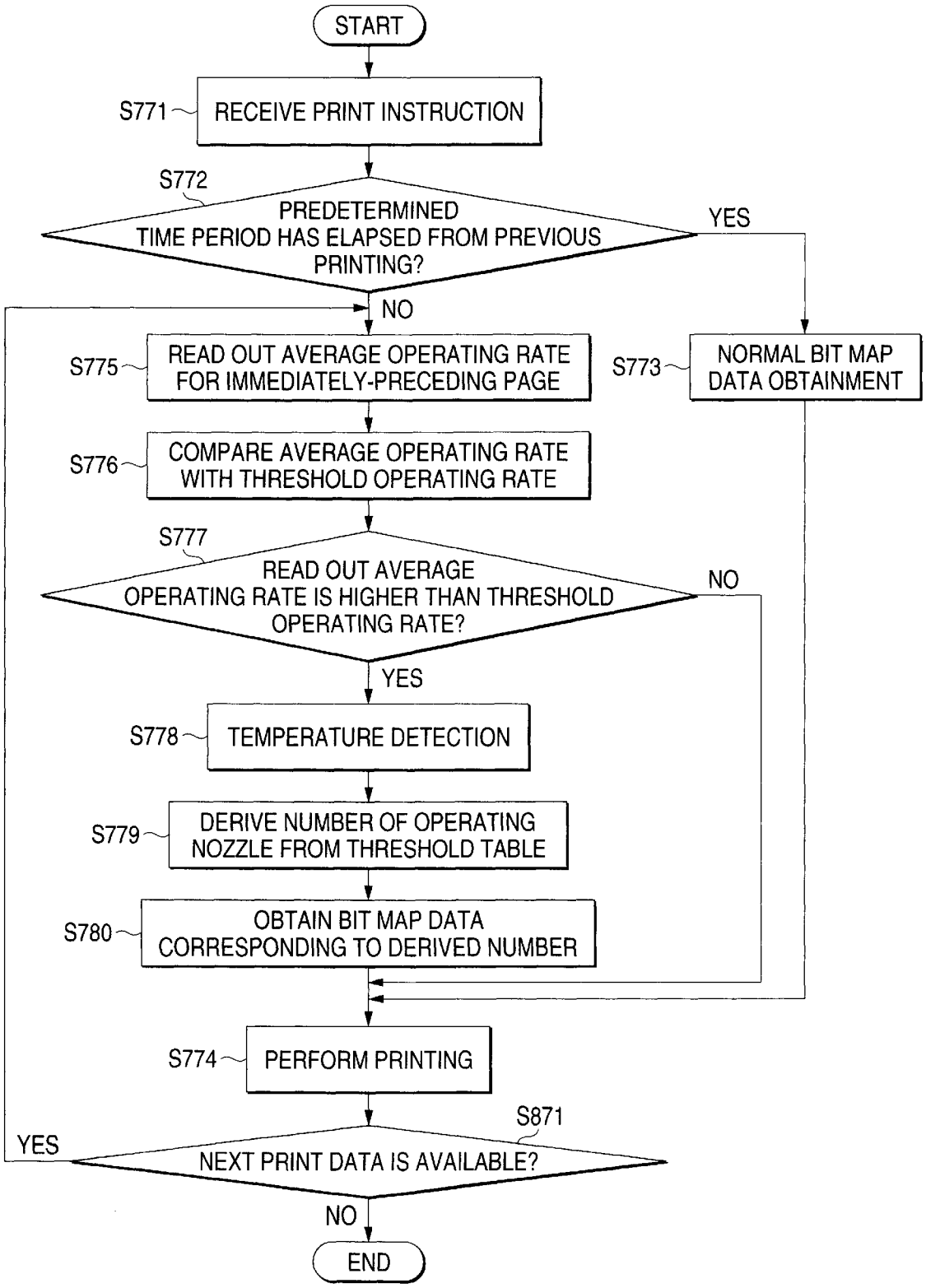
FIG. 24 is a flowchart showing processing operation effected in an embodiment 3-7 of the invention.

FIG. 24 is a flowchart showing processing operation in connection with an embodiment 3-7 of the invention. According to the flowchart shown in FIG. 24, when a print instruction has been received from the host apparatus 1 such as a host computer (see FIG. 2) and when a predetermined time period has not yet elapsed since receipt of the preceding print instruction, there is performed processing substantially identical with that shown in FIG. 21 in connection with the embodiment 3-4.

As shown in FIG. 24, when a print instruction has been received from the host apparatus 1 such as a host computer (see FIG. 2) (step S771), a determination is made as to whether or not a predetermined time period has elapsed since receipt of the previous print instruction (S772). Here, if a predetermined time period has elapsed (when YES is selected in step S772), heat generated from the power transistor of the print head 11 will have been sufficiently dissipated. Hence, an image is developed into buffers in a common manner (S773), and printing is performed (step S774). In contrast, if a predetermined time period has not elapsed since receipt of the previous print instruction (when NO is selected in step S772), there is performed processing completely identical with that shown in FIG. 20 in connection with the embodiment 3-4. More specifically, the dot counter 25 counts an average duty factor for an immediately-preceding page (step S775). The operating rate comparator 31 reads the average duty factor for the immediately preceding page, and compares the thus-read duty factor with a threshold operating value (i.e., standard value) read from the threshold table storage 27 (step S776). On the basis of the comparison result, a determination is made as to whether or not the average duty factor for the immediately-preceding page is greater than the standard value (step S777). If the average duty factor for the immediately-preceding page is greater than the standard value (when YES is selected in step S777), a temperature is detected. More specifically, the thermistor 15 attached to the heat sink of the power transistor outputs a detection signal corresponding to a change in the temperature of the heat sink, and the threshold operating rate selector 29 ascertains an internal ambient temperature by reading the temperature detection signal from the thermistor 15 (step S778). After the temperature has been detected, the number of nozzles corresponding to the thus-detected temperature is acquired from the table 100 (see FIG. 14) (step S779). When an image is converted into a bitmap data for subsequent buffers, processing is performed on the basis of assumption of use of a print head having the number of nozzles acquired from the table 100 (see FIG. 14) (step S870). As a result, there is inhibited heat to be generated in the power transistor of the print head 11, and hence printing is performed (step S774). Until no next print data become available, processing pertaining to step S775 and subsequent steps is repeated (when YES is selected in step S871). If no next print data have become available (when NO is selected in step S871), processing is terminated.

In steps S775 to S777, there may be configured that a temperature is detected when the average operating rate (duty factor) for the immediately-preceding line (raster) is greater than the standard value. The number of nozzles (i.e., a nozzle operating rate) may be adjusted according to the thus-detected temperature.

Figure 25:
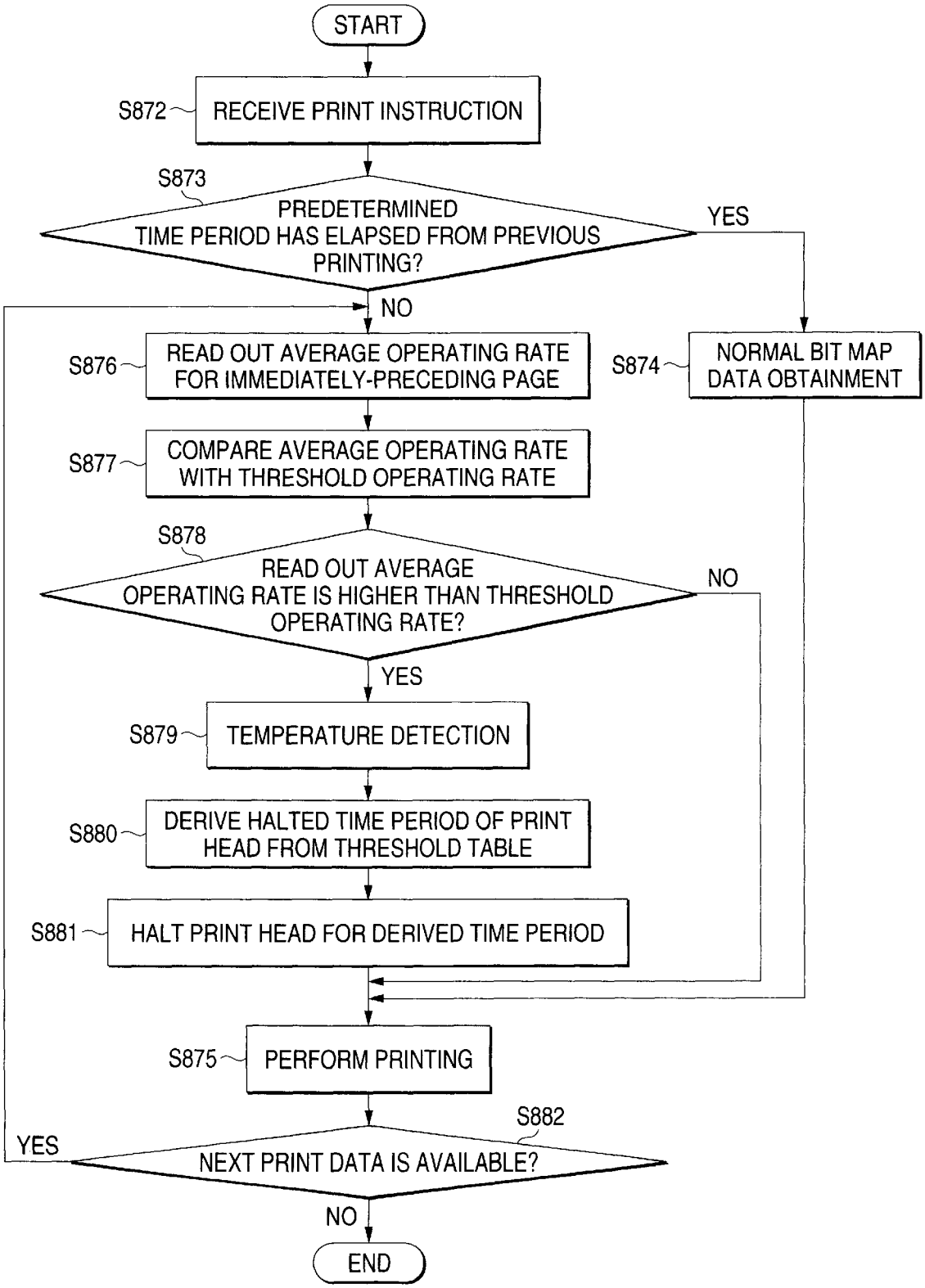
FIG. 25 is a flowchart showing processing operation effected in an embodiment 3-8 of the invention.

FIG. 25 is a flowchart showing processing operation in connection with an embodiment 3-8 of the invention. According to the flowchart shown in FIG. 25, when a print instruction has been received from the host apparatus 1 (see FIG. 2) such as a host computer, a determination is made as to whether or not a predetermined time period has elapsed since receipt of the print instruction, as in the case of the flowchart shown in FIG. 24 in connection with the embodiment 3-7. If a predetermined time period has not elapsed, there is performed a control operation for preventing heating of the power transistor. In the case shown in FIG. 23, the number of nozzles (i.e., a nozzle operating rate) is adjusted. In contrast, in the embodiment 3-8, operation of the print head 11 is halted for a given time period.

Steps S872 through S879 shown in FIG. 25 are completely identical with steps S771 through S778 shown in FIG. 24 in connection with the embodiment 3-7. In the embodiment 3-8, the average operating rate (duty factor) for an immediately-preceding page is compared with standard value (step S877). In a case where the average operating rate (duty factor) for the immediately-preceding page is greater than the standard value (when YES is selected in step S878), a temperature is detected (step S879). A halted time period corresponding to the detected temperature is acquired from the table 200 (see FIG. 15) (step S880). The print head 11 is halted for only the period of the time (step S881). As a result, there is inhibited heating of the power transistor of the print head 11, which is to be generated. Hence, printing is performed (step S875). Until no next print data become available, processing pertaining to step S876 and subsequent steps is repeated (when YES is selected in step S882). When no next print data have become available (when NO is selected in step S882), processing is terminated.

In steps S876 through S878, there may be configured that a temperature is detected when an average operating rate (duty factor) for an immediately-preceding line (raster) is greater than standard value. Operation of the print head 11 may be halted for a predetermined time period corresponding to the thus-detected temperature.

Figure 26:
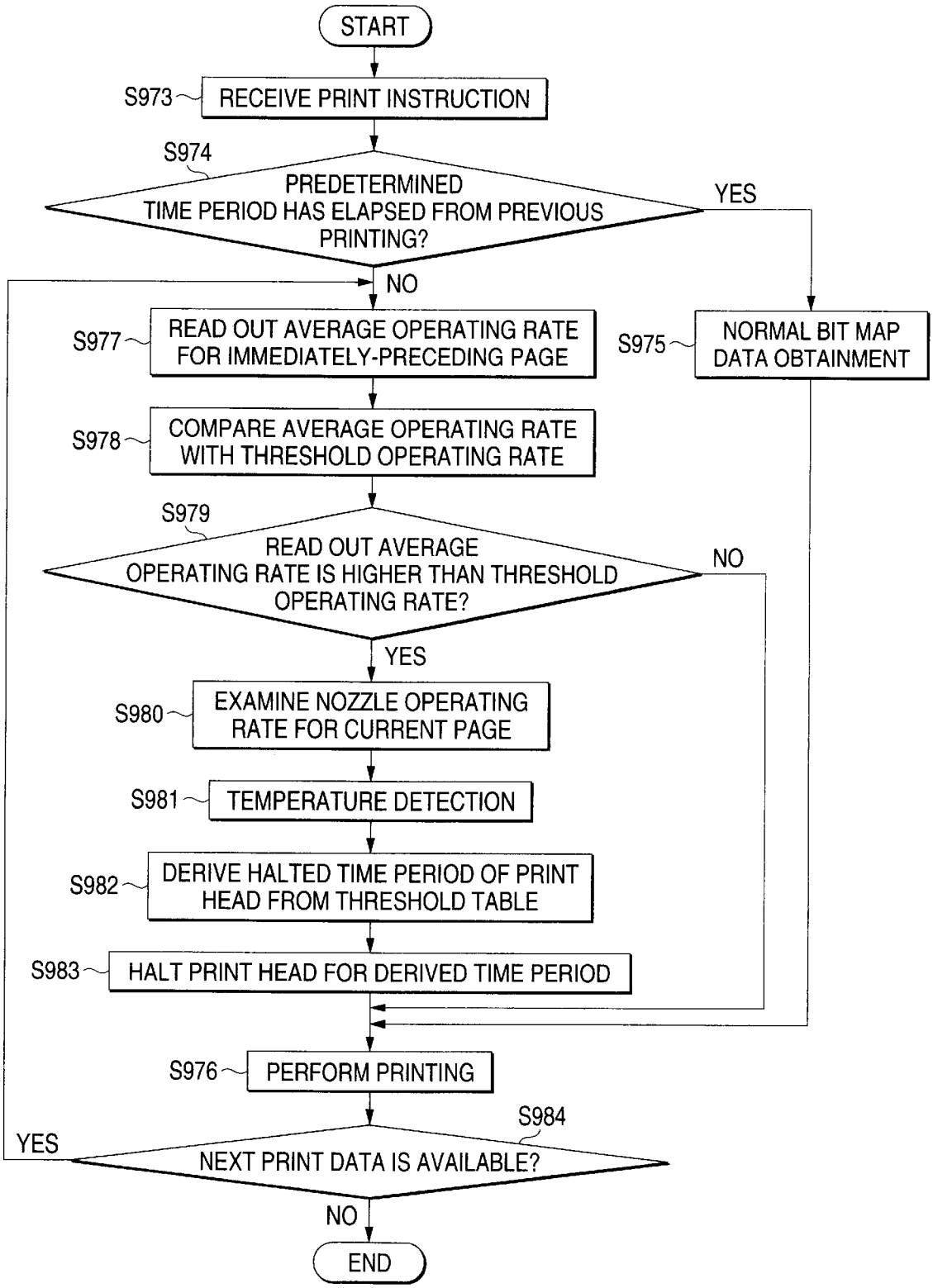
FIG. 26 is a flowchart showing processing operation effected in an embodiment 3-9 of the invention.

FIG. 26 is a flowchart showing processing operation in connection with an embodiment 3-9 of the invention. According to the flowchart shown in FIG. 26, when a print instruction has been received from the host apparatus 1 (see FIG. 2) such as a host computer, a determination is made as to whether or not a predetermined time period has elapsed since receipt of the print instruction, as in the case of the flowchart shown in FIG. 25 in connection with the embodiment 3-8. If a predetermined time period has not elapsed, the average operating rate for the immediately-preceding page is compared with the normalized data. If the former is greater than the latter, it is first examined a nozzle operating rate for the current page, and then a temperature detection is performed. A predetermined halted time period is acquired from a predetermined table according to both of the nozzle operating rate for the current page and the detected temperature, so that operation of the print head 11 is halted for only the period of the halted time period.

Steps S973 through S979 shown in FIG. 26 are completely identical with steps S872 through S878 shown in FIG. 25 in connection with the embodiment 3-8. In an embodiment 3-9, when the average operating rate (duty factor) for an immediately-preceding page is greater than the standard value (when YES is selected in step S979), a nozzle operating rate for the current page is examined (step S980). Then, a temperature is detected (step S981). A halted time period corresponding to the nozzle operating time for the current page and the detected temperature is acquired from the table 400 (see FIG. 17) (step S982). Operation of the print head 11 is halted for only the period of the halted time period (step S983). Here, the "nozzle operating rate intrinsic to print data" shown in the table 400 shown in FIG. 17 is regarded as "nozzle operating rate for a current page." As a result of lapse of the time, heat generated from the power transistor in the print head 11 is sufficiently dissipated, and hence printing is resumed (step S976). Processing pertaining to step S977 to subsequent steps is repeated (when YES is selected in step S984) until no next print data become available. If no next print data have become available (when NO is selected in step S984), processing is terminated.

In steps 977 through 979, there may be configured that a nozzle operating rate for a current line is examined, and a temperature is detected when an average operating rate (duty factor) for an immediately-preceding line is greater than standard value data. Operation of the print head 11 may be halted in accordance with the nozzle operating rate for the current line and the detected temperature.

Figure 27:
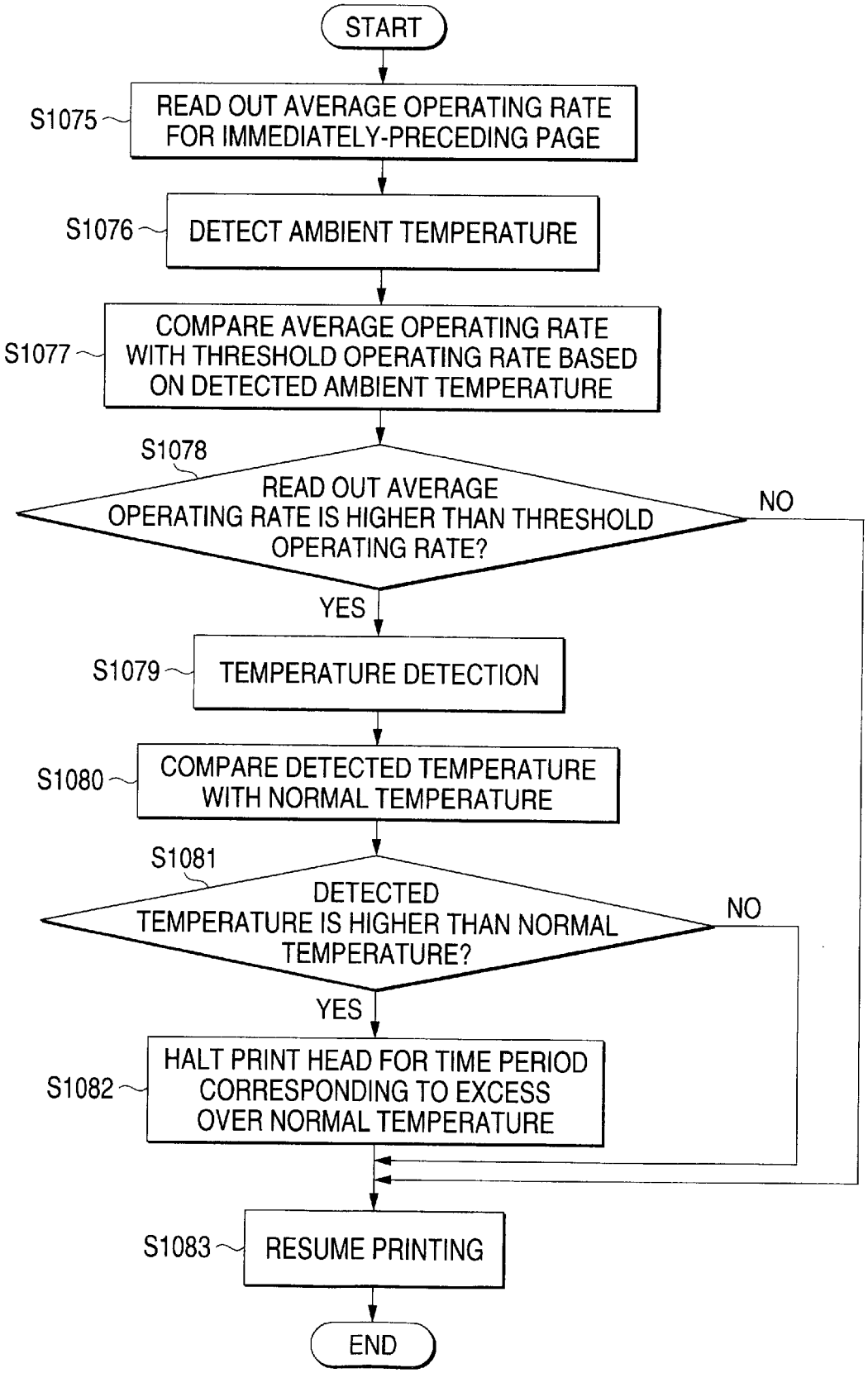
FIG. 27 is a flowchart showing processing operation effected in an embodiment 3-10 of the invention.

FIG. 27 is a flowchart showing processing operation in connection with an embodiment 3-10 of the invention. According to the flowchart shown in FIG. 27, after an average operating rate (duty factor) for an immediately-preceding page has been computed, an ambient temperature is detected by another thermistor which differs from the thermistor 15 and is provided in the print head 11 for stabilizing ink ejection. Control operation is performed while the standard value data allowing for the ambient temperature are compared with the average operating rate (duty factor) for an immediately-preceding page.

As shown in FIG. 27, after an average operating rate (duty factor) for an immediately-preceding page has been computed (step S1075), an ambient temperature is detected by use of the other thermistor (step S1076). The standard value data allowing for the ambient temperature are compared with the average operating rate (duty factor) for an immediately-preceding page (step S1077). A determination is made as to whether or not the average operating rate for an immediately-preceding page (duty factor) is greater than the standard value data (step S1078). If the average operating rate (duty factor) for an immediately-preceding page is greater than the standard value data (when YES is selected in step S1078), the temperature of the power transistor (heat sink) is detected by the thermistor 15 (step S1079). The temperature detected by the thermistor 15 is compared with the standard value data (step S1080). When the detected temperature is higher than the standard value data (when YES is selected in step S1081), a time into which a difference between the detected temperature and the standard value data has been converted is taken as a halted time period (step S1082) As a result of lapse of the time, heat generated from the power transistor of the print head 11 is sufficiently dissipated, and hence printing is resumed (step S1083). Then, processing is terminated.

An example of threshold operating rate data allowing for the ambient temperature is provided in table 500 shown in FIG. 28. As is evident from the table 500 shown in FIG. 28, there often arises a case where the higher the ambient temperature of the print head, the higher the temperature of the power transistor. Hence, a threshold value of duty factor is set low correspondingly. For instance, if an ambient temperature is 40° C., a threshold value of duty actor is subjected to comparison while being taken as 100%

In steps 1075, 1077, and 1078, there may be configured that a temperature is detected when an average operating rate (duty factor) for an immediately-preceding line is greater than standard value data. Operation of the print head 11 may be halted for a given time period corresponding to the detected temperature.

Although specific embodiments of the invention have been described above, the invention is not limited thereto; the invention is also applicable to other embodiments falling within the scope described in the appended claims.

What is claimed is:

1. A printing apparatus, comprising:

a print head mechanism, which performs printing predetermined image information on a fed recording medium, based on a given control signal;

a detector, which detects an operating rate of the print head mechanism at a predetermined region on the recording medium every time when printing with respect to the predetermined region is finished;

a comparator, which compares the operating rate with a given threshold operating rate; and controller, which halts the print head mechanism, when the operating rate exceeds the threshold operating rate, for a halting time period corresponding to an excess amount of the operating rate.

2. The printing apparatus as set forth in claim 1, wherein:

the printing apparatus is a serial printer;

the recording medium is print paper; and the predetermined region is either one raster or one page defined on the recording medium.

3. The printing apparatus as set forth in claim 1, wherein the operating rate is an average operating rate which is determined by either an ink dot count or a consumed ink amount while the print head mechanism performs printing the image information on the recording medium.

4. The printing apparatus as set forth in claim 1, wherein the threshold operating rate is varied in accordance with change in an external ambient temperature of the printing apparatus.

5. The printing apparatus as set forth in claim 4, wherein the change in the external ambient temperature is detected based on a temperature detection signal sent from a temperature detector provided externally.

6. The printing apparatus as set forth in claim 1, wherein the operating rate is varied in accordance with change in an internal ambient temperature of the printing apparatus.

7. The printing apparatus as set forth in claim 6, wherein the change in the internal ambient temperature is detected based on a temperature detection signal sent from a temperature detector provided with the print head mechanism.

8. The printing apparatus as set forth in claim 1, wherein the operating rate is varied in accordance with change in a temperature of a semiconductor switching element in a drive circuit for driving the print head mechanism.

9. The printing apparatus as set forth in claim 8, wherein the change in the internal ambient temperature is detected based on a temperature detection signal sent from a temperature detector provided with the semiconductor switching element.

10. The printing apparatus as set forth in claim 1, wherein when the halting time period is longer than either a raster changing time period of the print head mechanism or a standby time period for which printing on a new recording medium is started, the print head mechanism is halted for a time period corresponding to a difference between the halting time period and the raster changing time period or the standby time period.

11. An apparatus for controlling a print head mechanism, which performs printing predetermined image information on a fed recording medium, based on a given control signal, comprising:

a detector, which detects an operating rate of the print head mechanism at a predetermined region on the recording medium every time when printing with respect to the predetermined region is finished;

a comparator, which compares the operating rate with a given threshold operating rate; and controller, which halts the print head mechanism, when the operating rate exceeds the threshold operating rate, for a halting time period corresponding to an excess amount of the operating rate.

12. A method for controlling a print head mechanism, which performs printing predetermined image information on a fed recording medium, based on a given control signal, comprising the steps of:

detecting an operating rate of the print head mechanism at a predetermined region on the recording medium every time when printing with respect to the predetermined region is finished;

comparing the operating rate with a given threshold operating rate; and halting the print head mechanism, when the operating rate exceeds the threshold operating rate, for a halting time period corresponding to an excess amount of the operating rate.

13. A computer program for controlling a print head mechanism, which performs printing predetermined image information on a fed recording medium, based on a given control signal, comprising the steps of:

detecting an operating rate of the print head mechanism at a predetermined region on the recording medium every time when printing with respect to the predetermined region is finished;

comparing the operating rate with a given threshold operating rate; and halting the print head mechanism, when the operating rate exceeds the threshold operating rate, for a halting time period corresponding to an excess amount of the operating rate.

14. A printing apparatus, comprising:

a temperature monitor, which monitors a temperature of a transistor which generates a voltage waveform for driving a print head to transmit temperature information; and a drive controller, which drives the print head while reducing an operation rate of nozzles in the print head, based on the temperature information transmitted from the temperature monitor.

15. The printing apparatus as set forth in claim 14, wherein:

the drive controller includes a storage which stores temperatures of the transistor to be monitored in association with numbers of operable nozzle; and the drive controller reads a number of operable nozzle from the storage based on the temperature information so that only the read number of nozzles are operated to reduce the operating rate.

16. The printing apparatus as set forth in claim 15, wherein the numbers of operable nozzle are stored in association with each color nozzle array.

17. The printing apparatus as set forth in claim 16, wherein the numbers of operable nozzle for the respective nozzle arrays are identical with each other.

18. The printing apparatus as set forth in claim 16, wherein the numbers of operable nozzle for the respective nozzle arrays are different from each other.

19. The printing apparatus as set forth in claim 16, wherein:

the number of operable nozzle is determined with respect to total number of nozzles of all nozzle arrays; and the drive controller sets the number of operable nozzle for each color nozzle array in a real-time manner.

20. The printing apparatus as set forth in claim 14, wherein the drive controller includes a past operation evaluator, which determines whether the reduction of nozzle operation rate is performed upon a current printing, based on a past nozzle operation of the print head.

21. The printing apparatus as set forth in claim 20, wherein the past operation evaluator performs the determination based on a time period elapsed from a previous driving of the print head.

22. The printing apparatus as set forth in claim 20, wherein the past operation evaluator performs the determination based on an accumulated count of nozzle operation at a previous driving of the print head.

23. The printing apparatus as set forth in claim 14, wherein the drive controller performs the reduction of nozzle operation rate, only when a print head is not in a scanning operation.

24. A printing apparatus, comprising:

a temperature monitor, which monitors a temperature of a transistor which generates a voltage waveform for driving a print head to transmit temperature information; and a drive controller, which drives the print head while reducing an operation rate of nozzles in the print head, based on the temperature information transmitted from the temperature monitor, wherein:

the drive controller includes a storage which stores temperatures of the transistor to be monitored in association with time periods for which nozzle operation is halted; and the drive controller reads a time period from the storage based on the temperature information so that nozzle operation is halted for the read time period.

25. The printing apparatus as set forth in claim 24, wherein the drive controller includes a past operation evaluator, which determines whether the halt of nozzle operation is performed upon a current printing, based on a past nozzle operation of the print head.

26. The printing apparatus as set forth in claim 25, wherein the past operation evaluator performs the determination based on a time period elapsed from a previous driving of the print head.

27. The printing apparatus as set forth in claim 25, wherein the past operation evaluator performs the determination based on an accumulated count of nozzle operation at a previous driving of the print head.

28. The printing apparatus as set forth in claim 24, wherein the drive controller does not perform the halt of nozzle operation while the print head is in a scanning operation.

29. A printing apparatus, comprising:

a temperature monitor, which monitors a temperature of a transistor which generates a voltage waveform for driving a print head to transmit temperature information;

a drive controller, which drives the print head while reducing an operation rate of nozzles in the print head, based on the temperature information transmitted from the temperature monitor; and a storage which stores temperatures of the transistor to be monitored in association with time periods for which nozzle operation is halted, wherein the drive controller reads a time period from the storage based on the temperature information so that nozzle operation is halted for the read time period.

* * * * *